United States Patent [19]

Lynch

[11] Patent Number: 4,505,629

[45] Date of Patent: Mar. 19, 1985

[54] BOOK BINDING MACHINE

[75] Inventor: Michael A. Lynch, Keene, N.H.

[73] Assignee: permaTek, Inc., Las Vegas, Nev.

[21] Appl. No.: 379,037

[22] Filed: May 17, 1982

[51] Int. Cl.[3] ..... B42C 11/00

[52] U.S. Cl. ..... 412/5; 412/19; 412/21; 412/29; 493/334

[58] Field of Search ..... 412/3, 4, 5, 8, 11, 412/12, 19, 20, 21, 22, 23, 24, 25, 29, 902; 493/334, 402, 403, 396–399

[56] References Cited

U.S. PATENT DOCUMENTS

| | | | |
|---|---|---|---|
| 1,252,879 | 1/1918 | Bredenberg | 412/12 |
| 1,392,117 | 9/1921 | Clark | 412/12 |
| 2,853,725 | 9/1958 | Schoenberger | 412/22 |
| 3,123,848 | 3/1964 | Smith, Jr. et al. | 412/22 X |
| 3,314,089 | 4/1967 | Margolis et al. | 412/3 |
| 3,708,813 | 1/1973 | Carter et al. | 412/22 |
| 4,074,382 | 2/1978 | Palme et al. | 412/902 |

*Primary Examiner*—Paul A. Bell
*Attorney, Agent, or Firm*—Daniel M. Rosen

[57] ABSTRACT

A book making machine comprising casing-in instrumentalities and, optionally, building-in instrumentalities arranged so that the operations required to wrap a book with a cover are effected rectilinearly in succession comprising a cover feeder for delivering covers, one at a time, to a conveyor for movement along a predetermined path and, in succession, a heater for heating the covers, an embosser for embossing the covers to form fold lines, an adhesive-applying device for applying adhesive to the covers, a book feeder for depositing book inserts on the covers, registering devices for registering the inserts with the covers, wrapping devices for wrapping the covers about the inserts, pressure-applying devices for applying pressure to the wrapped inserts and forming devices for forming hinges in the cover panels at the back of the book.

32 Claims, 28 Drawing Figures

BOOK BINDING MACHINE

BACKGROUND OF INVENTION

Book binding machines are old in the art. However, most such machines are complicated by the fact that the covering operation is performed on the book insert held in a back-up or spine-up attitude, whereupon the back or spine is coated with adhesive and thereafter the cover is deposited astride the back. Further operations on the book to complete the covering operation require repositioning the book for application of pressure and formation of the hinges at the spine. It is the purpose of this invention to greatly simplify and increase the rate of book binding done by performing the entire operation continously and uninterruptedly without change of position by depositing the book, one broad side down, on an outspread cover and then wrapping the cover about the book.

SUMMARY OF INVENTION

As herein illustrated, the apparatus comprises rectilinearly arranged means for depositing book covers, one at a time, in a horizontal position with their inner sides facing upwardly for movement along a predetermined path, means defining a conveyor for moving the book covers along said path, means for applying adhesive to the entire upwardly-facing surface of each cover, means for depositing an insert, one broad side down, upon the cover at one side of the longitudinal center line, means for positioning the insert on the cover at the one side of the center line at a distance therefrom corresponding to one-half the thickness of the insert and means for wrapping the portion of the cover extending laterally from the insert about the back of the insert and into engagement with the upwardly-facing broad side of the insert. There is means for preconditioning the upwardly-facing side of the cover, means for embossing the preconditioned area of the cover with longitudinally-disposed, spaced, parallel depressions constituting fold lines formed at a spacing corresponding to the thickness of the insert and means for applying adhesive to the entire upwardly-facing side of the cover. The means for depositing the book covers comprises a hopper structured to support a stack of covers for delivery of covers, one at a time, from the bottom of the stack onto the conveyor means for movement along the aforesaid predetermined rectilinear path. The hopper is provided with both transverse and longitudinal adjustments to accommodate covers of different dimensions. The means for conditioning the covers is a heater, for example, a radiant heater positioned above the conveyor for heating an area of the cover at least as wide as that portion of the cover which will embrace the back of the book. The means for embossing the back of the cover comprise transversely-spaced upper and lower embossing rolls, the upper rolls being provided with peripheral ribs and the lower rolls with peripheral grooves, the spacing between the ribs and grooves corresponding to the thickness of the insert. The means for applying the adhesive comprises a tray for receiving the adhesive and a plurality of transfer rolls, one of which rotates within the tray and another of which has an adhesive receiving surface which is substantially tangent to the conveyor upon which the covers rest as they are moved along the predetermined path. There is means for adjusting the applicator roll heightwise relative to the conveyor to accommodate book covers of different thickness. The means for depositing the inserts on the embossed and adhesive-coated covers comprises a hopper supported above the conveyor for receiving and holding a stack of books for deposit of one book at a time onto a cover resting on the conveyor therebelow. There is a power-operated ejector for ejecting the books, one at a time, from the bottom of the stack and a sensing device responsive to the presence of a cover on the conveyor therebelow to cause the power-operated means to eject a book onto the cover. The hopper is structured to provide for transverse and longitudinal adjustments for accommodating books of different dimensions. The means for positioning the books on the covers comprise edge guides arranged transversely to shift the book transversely with respect to the cover so that the book occupies a position at one side of the center line at a distance therefrom corresponding to one-half the thickness of the insert and feed dogs on the conveyor provided with offset surfaces which, by engagement with the trailing ends of the book and cover, position the book on the cover centrally with respect to the fore and aft ends of the cover. The means for wrapping the portion of the cover extending laterally from the insert after the registering operation comprise folding blades at the side of the conveyor where the back of the book lies which, respectively, lift the laterally projecting portion of the cover upwardly, press the back of the cover against the back or spine of the book and fold the portion of the cover laterally of the binding onto the upwardly-facing broad side of the book. The folding devices are supported for transverse adjustment to accommodate books of different size. Following folding, there is means for applying pressure to the upwardly-facing side of the book in the form of rollers supported with their peripheral surfaces in a position for tangential rolling engagement with the upper sides of the books. At this point in the book-making process, if hinge lines are not to be impressed in the cover portions of the book at the back or spine, the books may be discharged from the apparatus. If hinges are to be formed at the back of the book in the cover panels, the apparatus includes means for delivering the books, one at a time, between a pair of pressure-applying conveyors for application of pressure perpendicular to the broad sides of the books and for embossment of grooves in the cover panels at the back to provide hinges for the cover panels. The pressure-applying conveyors are in the form of endless belts of articulated rigid plates having opposed parallel surfaces, the conveyor belts being supported to enable applying pressure of a predetermined amount to the books and with means for varying the pressure. The means for forming the grooves comprise upper and lower disks supported for rotation about horizontal axes transverse to the direction of movement of the pressure-applying conveyor belts in a vertical plane such as to have tangential engagement with the back of the backs supported between the pressure-applying conveyors. The disks have peripheral edges of beveled configuration and are supported for adjustment as are the pressure-applying conveyors for books of different thickness. The disks are free-wheeling, that is, they are not driven, rotation of the disks taking place solely as the result of movement of the books relative to the disks. Desirably, there is means provided for heating the disks to augment the formation of the grooves which are to provide the hinges and to set them. There is means for driving the apparatus in the form of motors, drive shafts driven thereby and sprocket and chain means from the drive shafts to the instrumentalities which perform the operations referred to.

The invention resides not only in the apparatus, but the method performed thereby which comprises continuously moving book covers along a predetermined rectilinear path with their inner sides facing upwardly, depositing books, one broad side down, on the cover panels at one side of the center line of the cover panels at a distance therefrom corresponding to one-half the thickness of the books to be covered, raising the portions of the covers corresponding to the thickness of the books into engagement with the backs of the books and folding the cover panels at the other side onto the other broad sides of the books.

Prior to depositing the books on the covers, the latter are conditioned to make them amenable to embossment, for example, by heating and then embossing over an area of the cover corresponding to at least the length and width of the back of the book to be covered to define the back and cover panels and applying adhesive to the entire upwardly-facing side of the cover.

The invention will now be described in greater detail with reference to the accompanying drawings, wherein.

Figures 3, 3A:
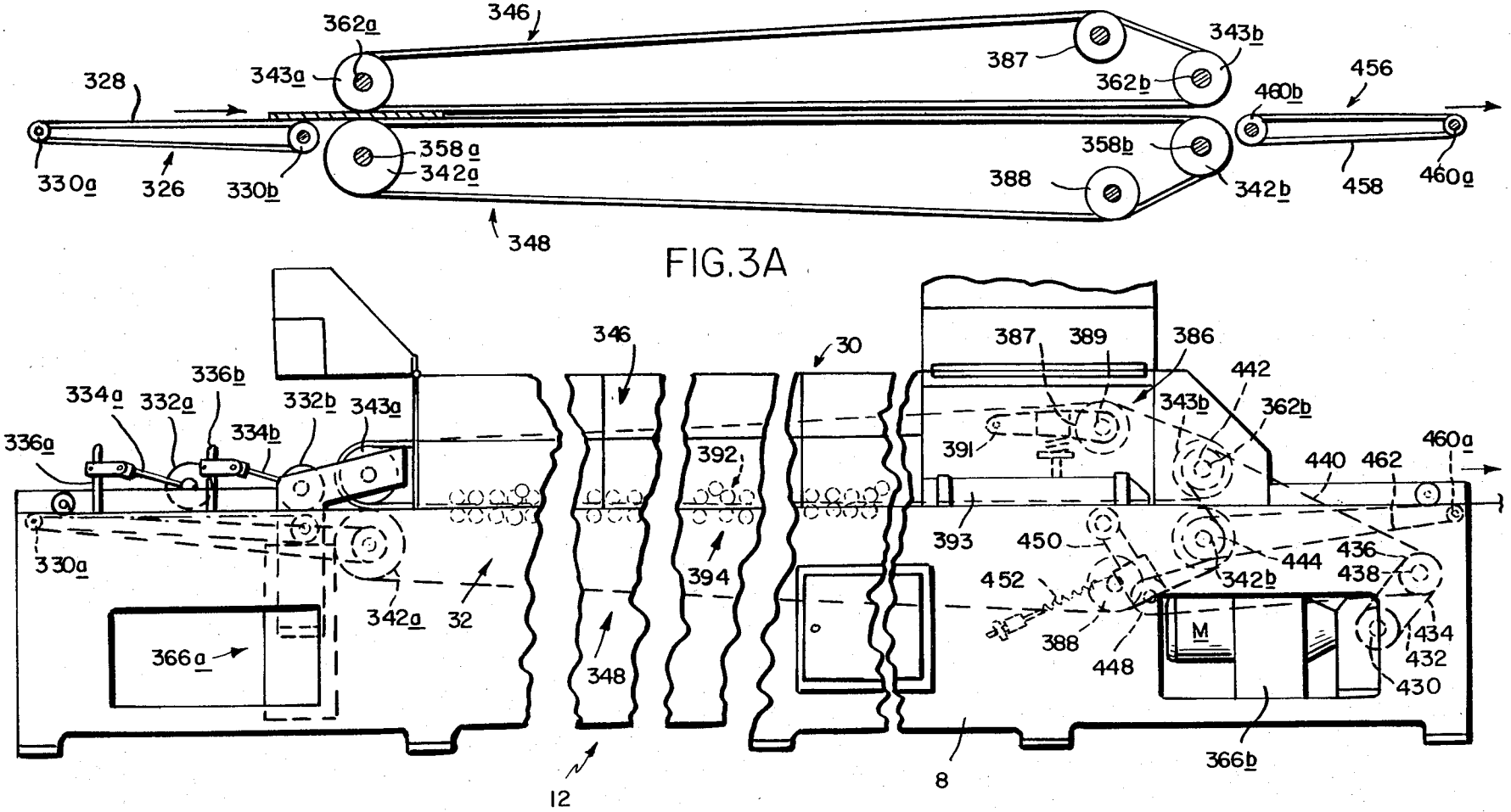
FIG. 3 is an elevation of the building-in section of the machine.
Figure 4:
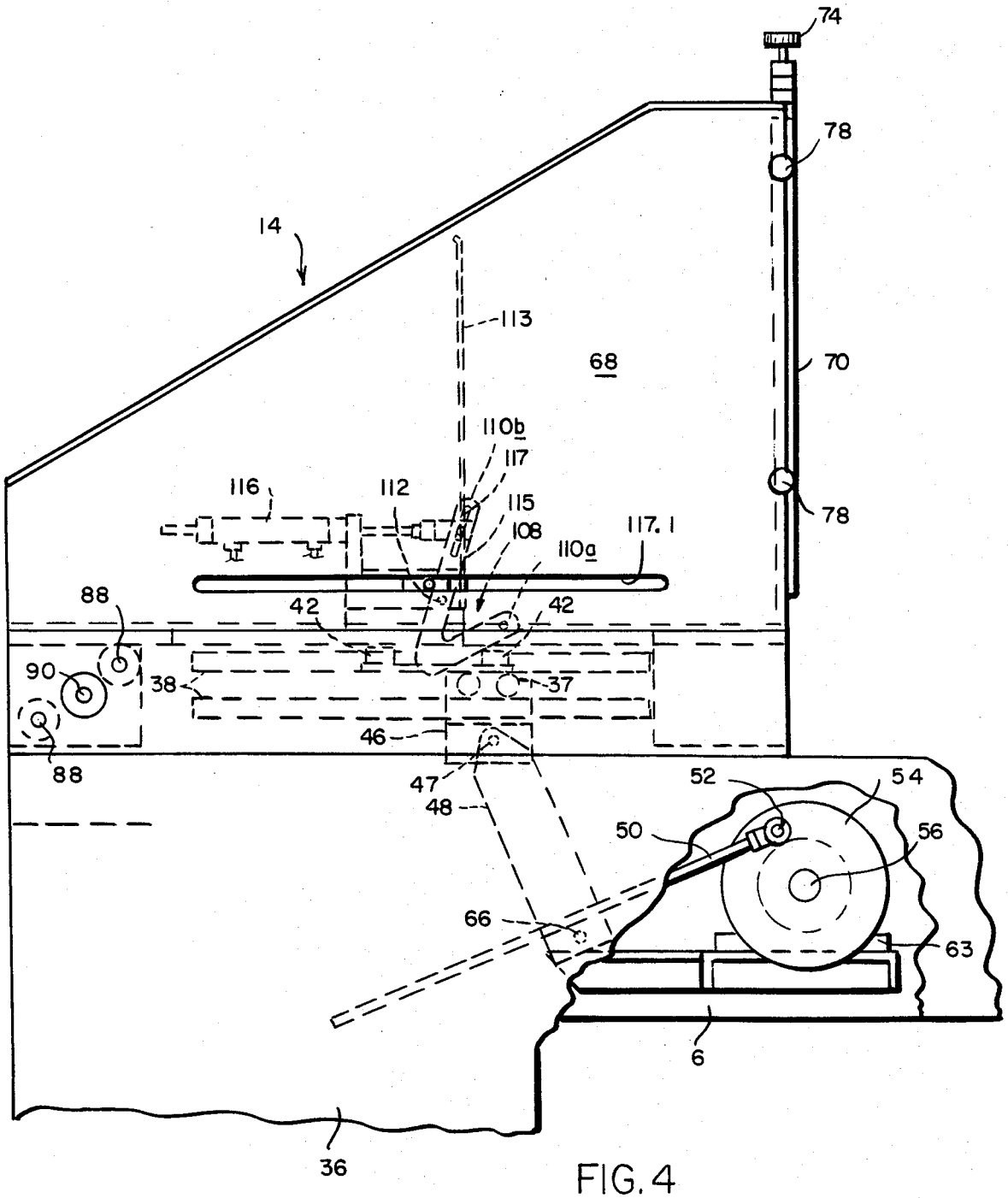
Figure 5:
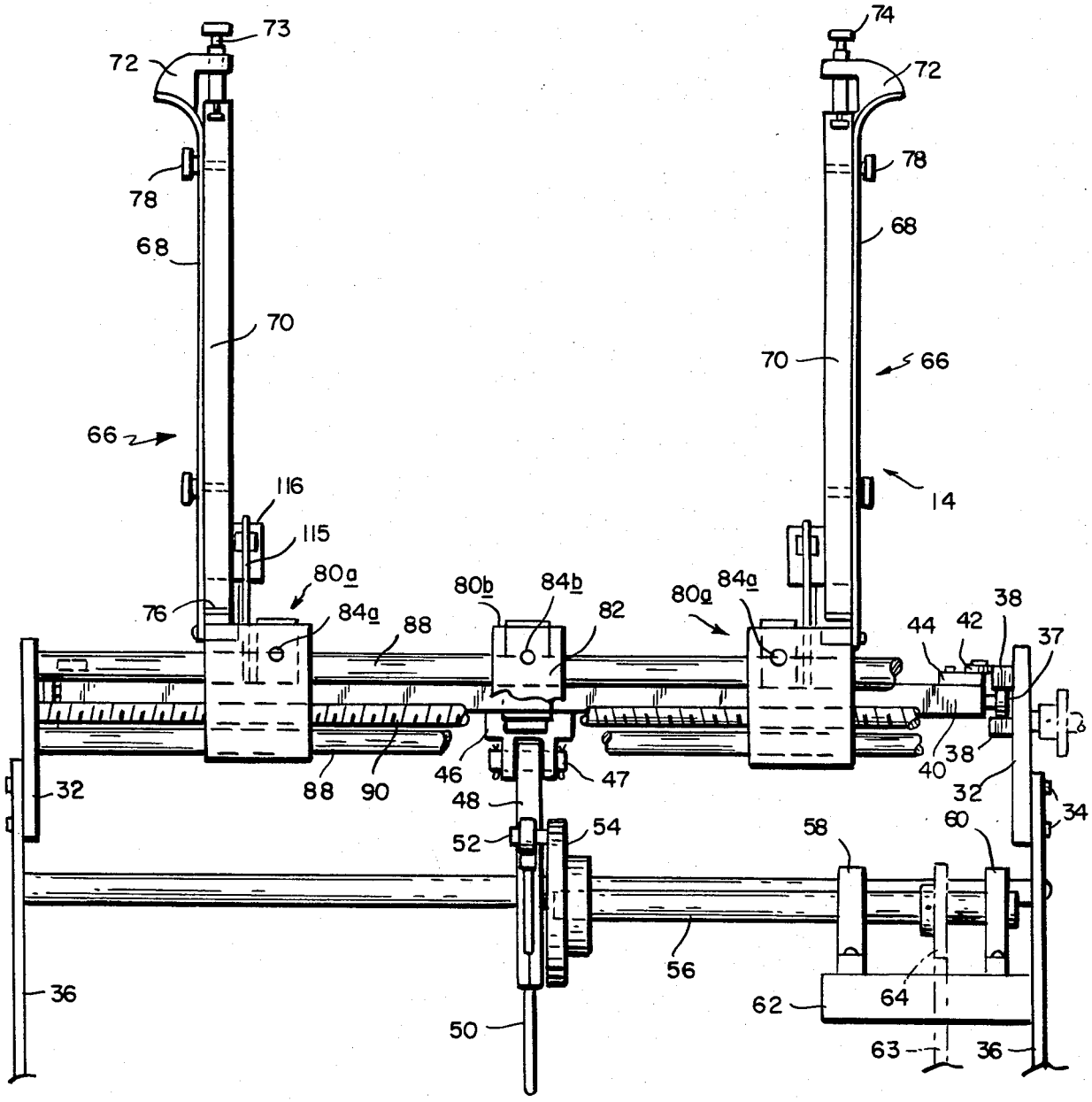
Figure 6B:
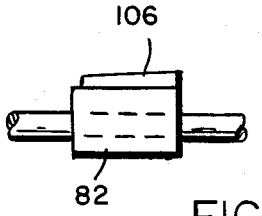
Figure 6:
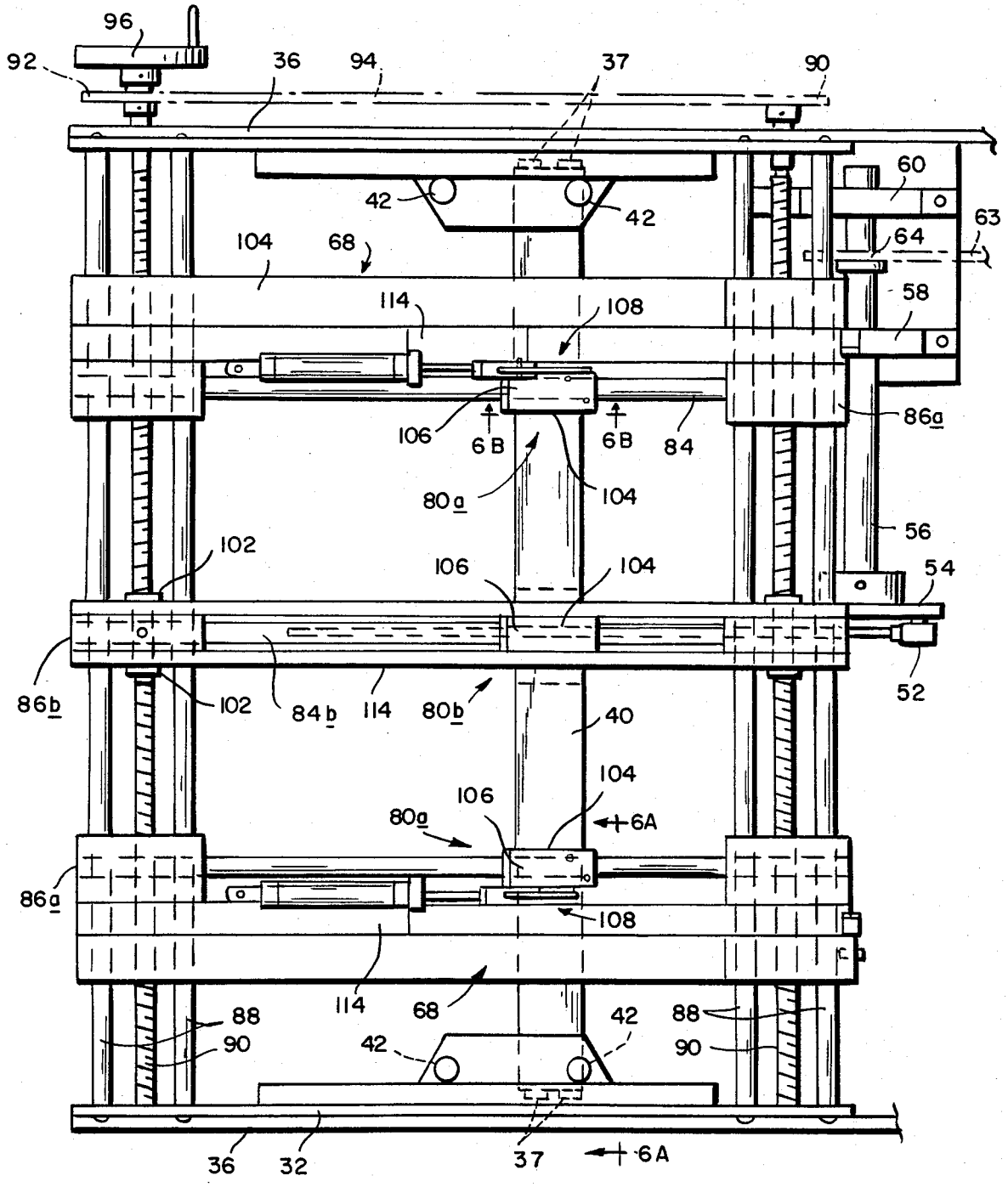
Figure 6A:
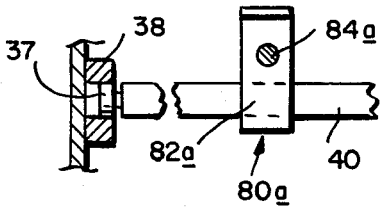
Figure 7:
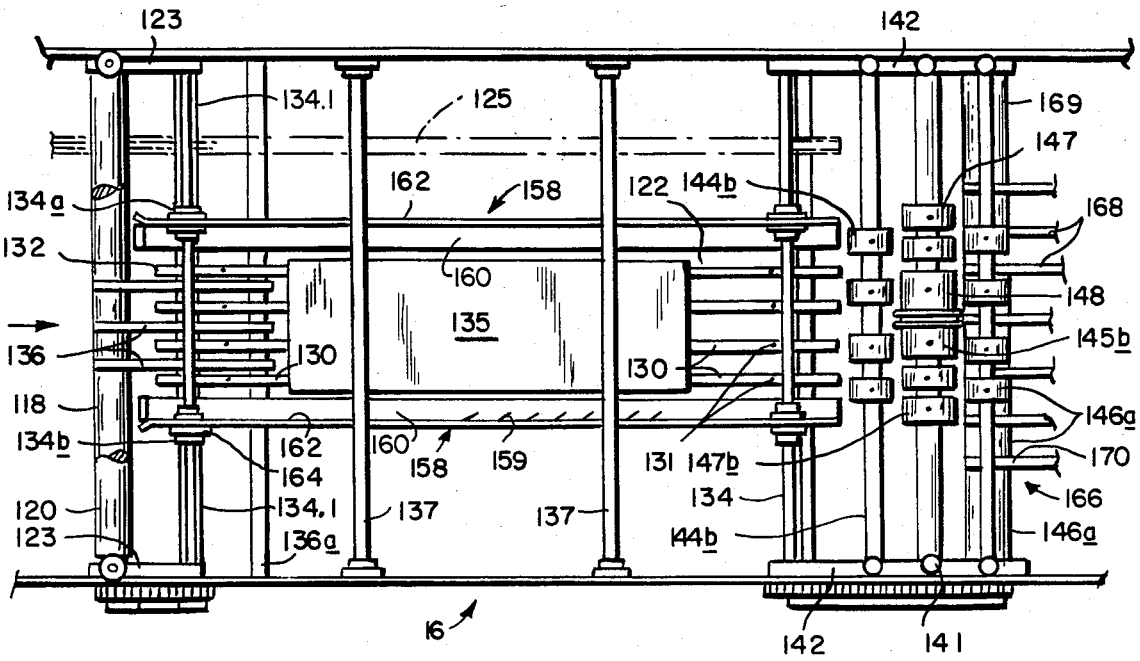
Figure 8:
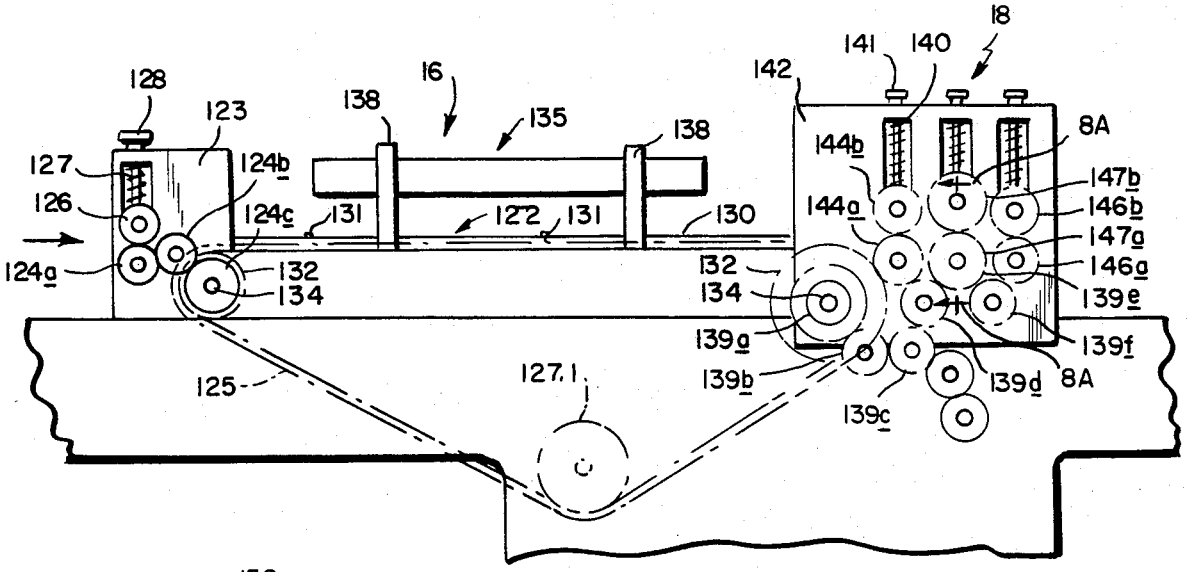
Figure 8A:
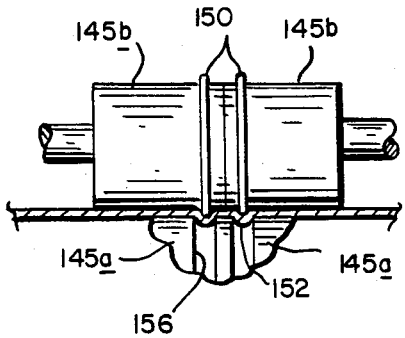
Figure 9:
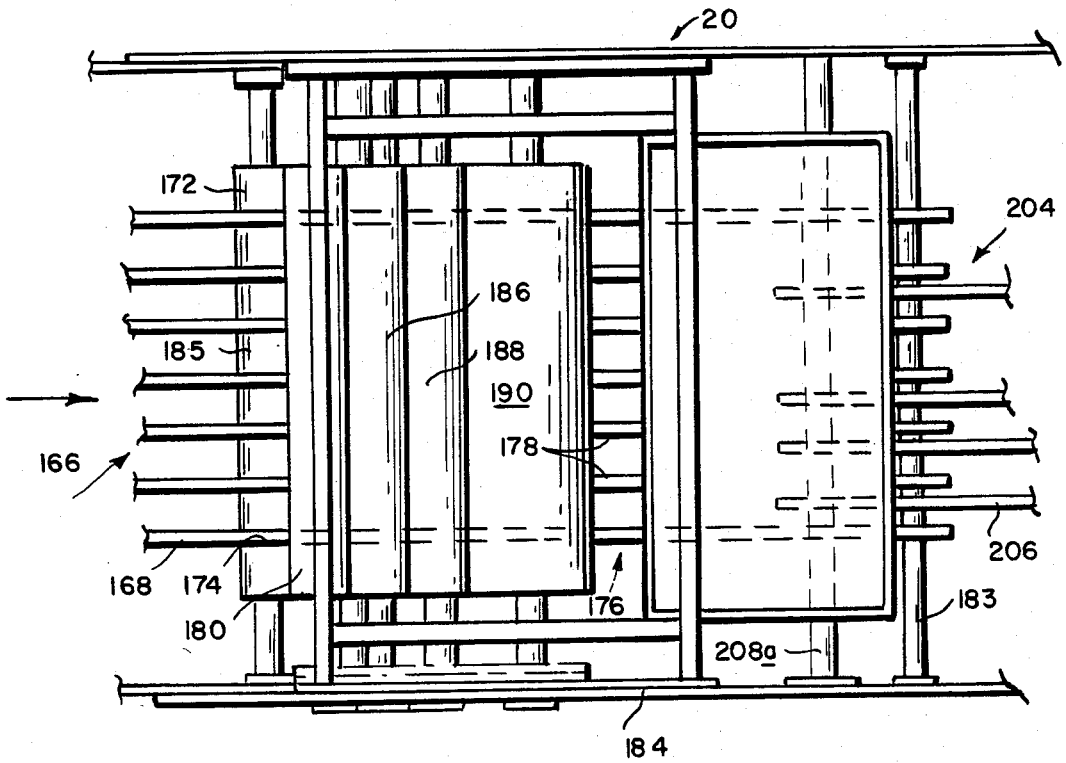
Figure 10:
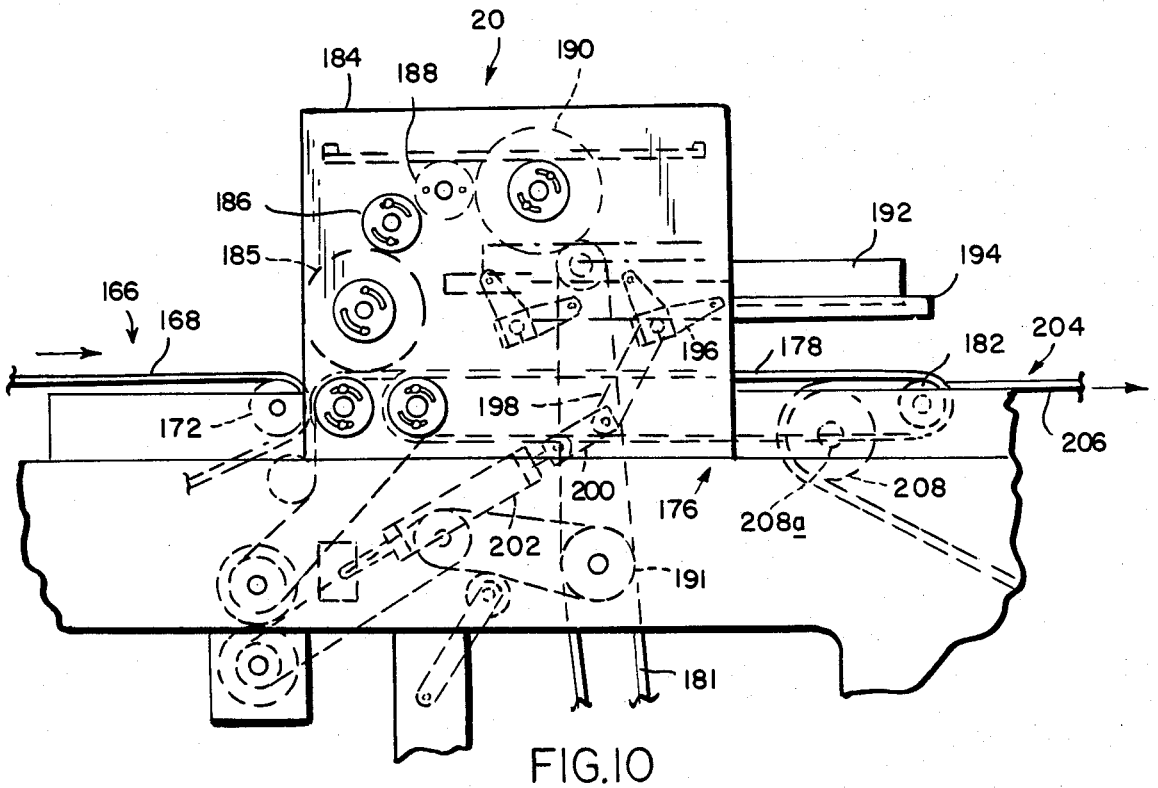
Figure 11:
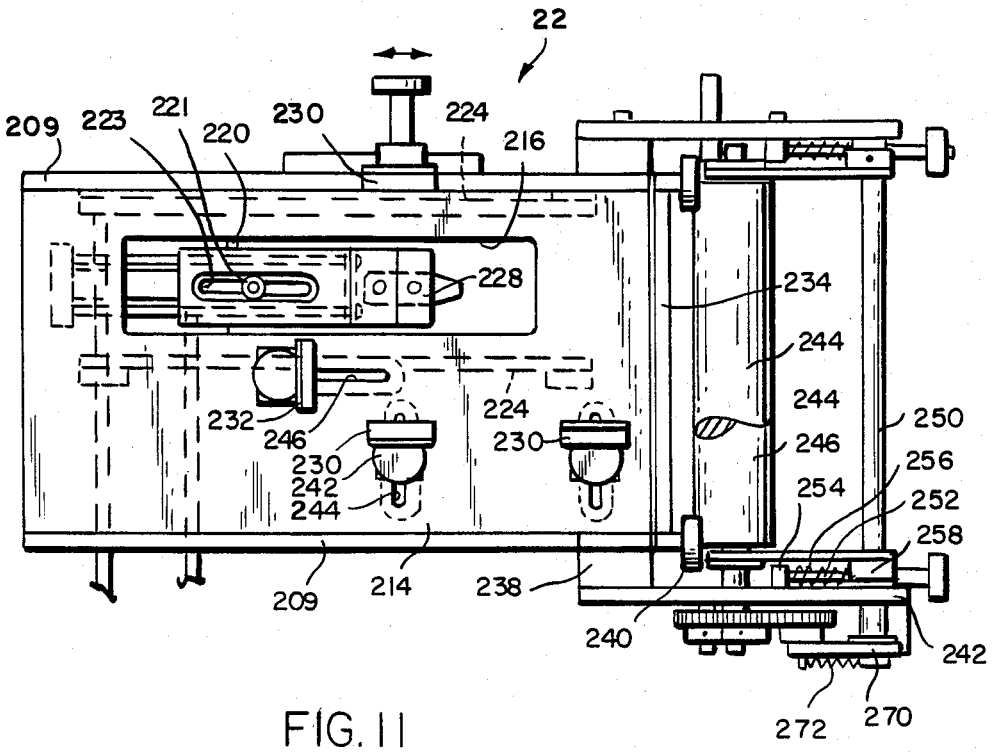
Figure 12:
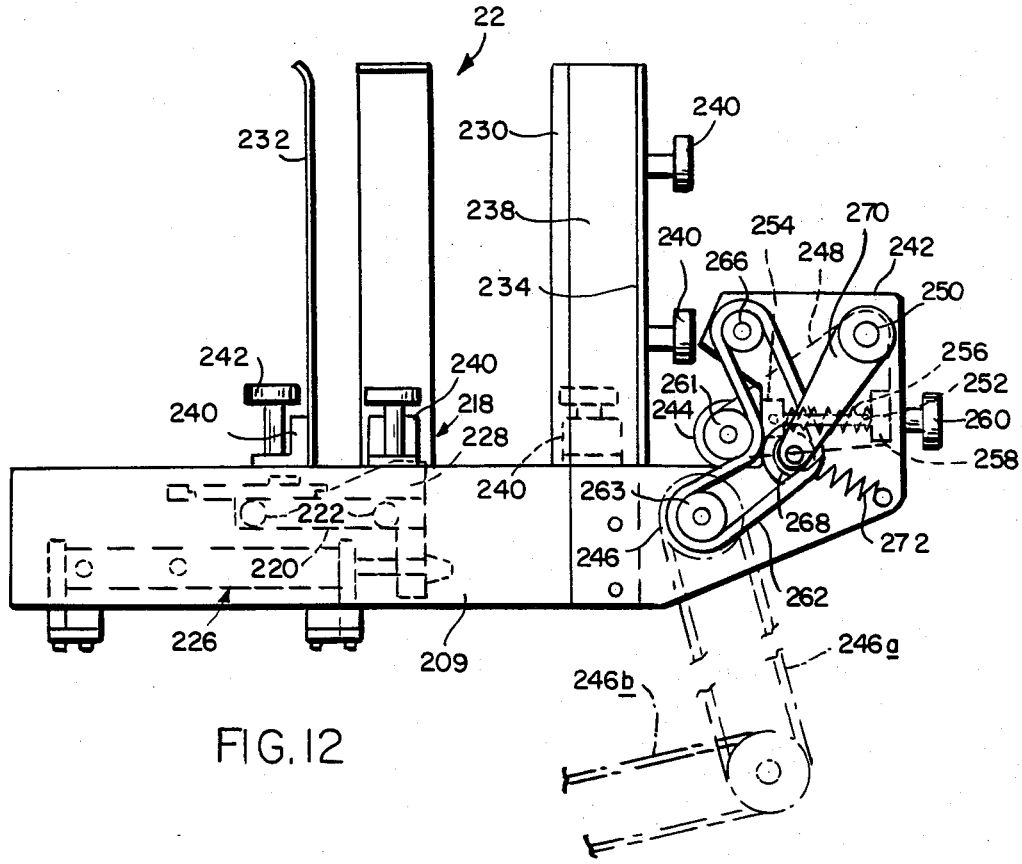
Figure 13:
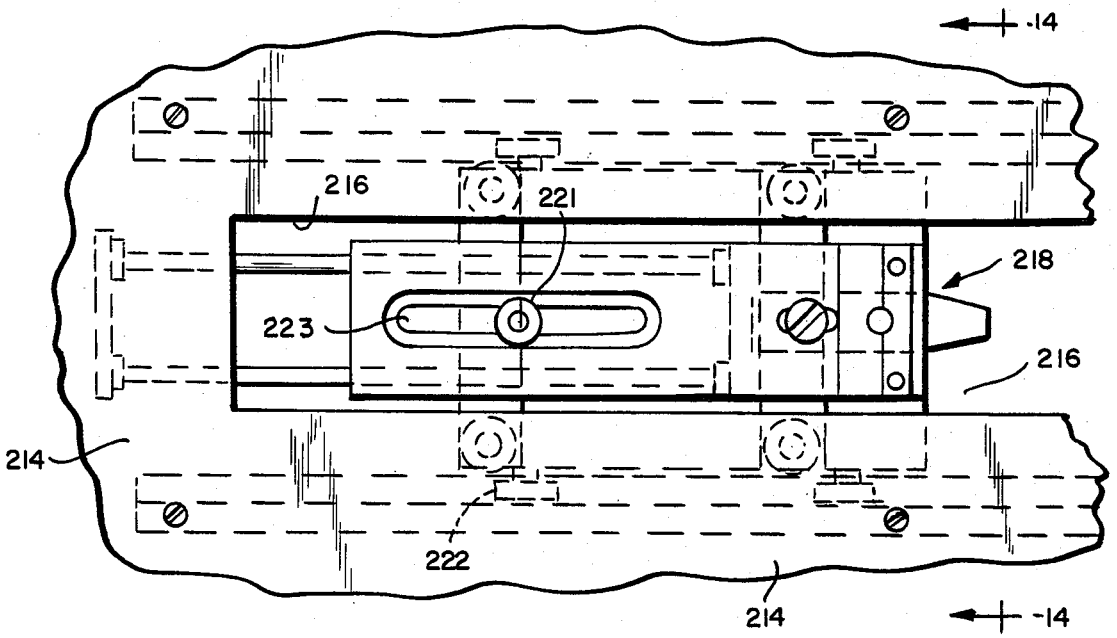
Figure 14:
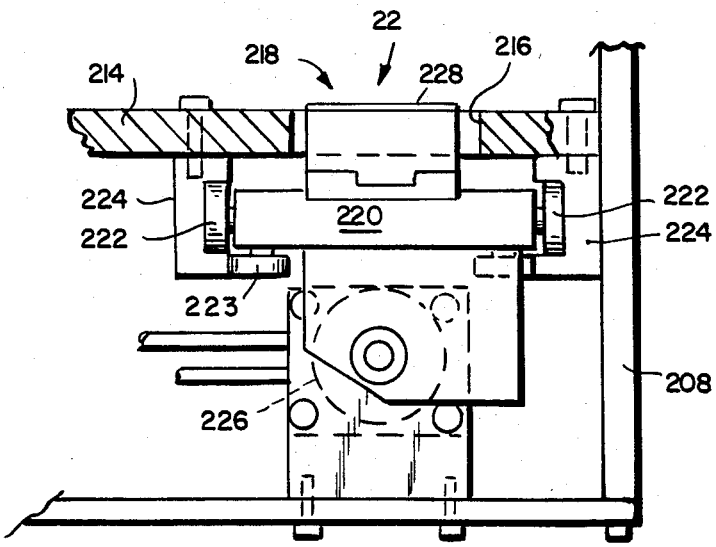
Figure 15:
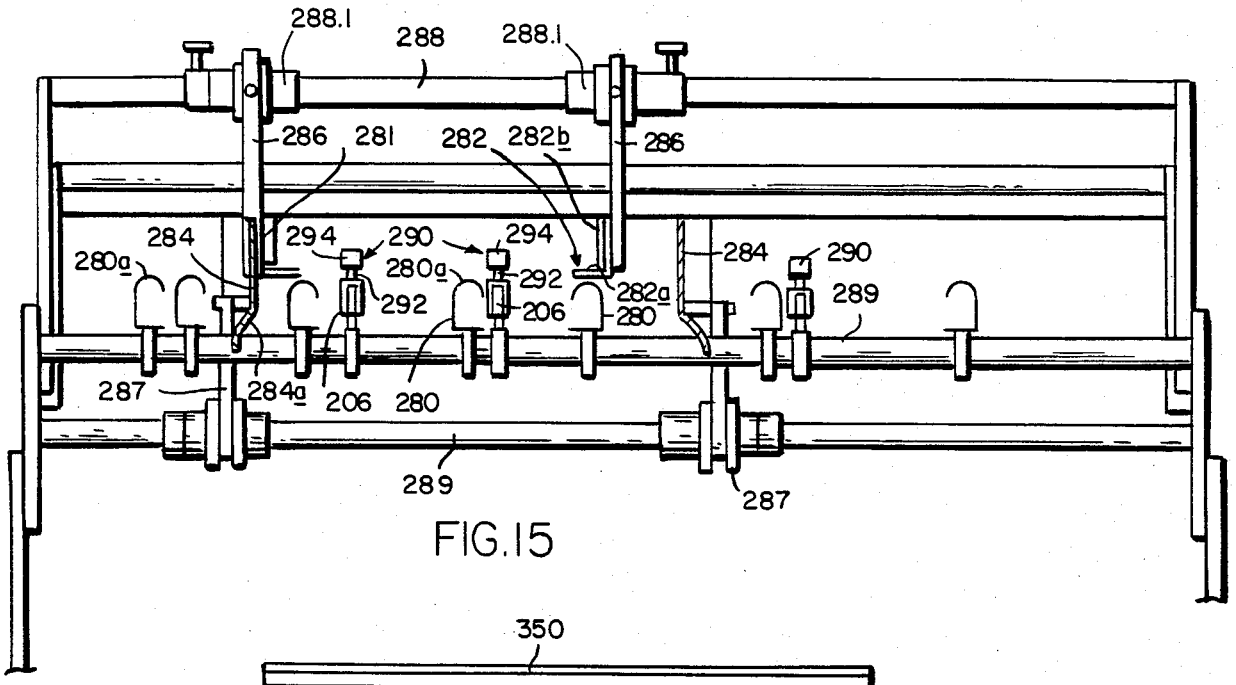
Figure 21:
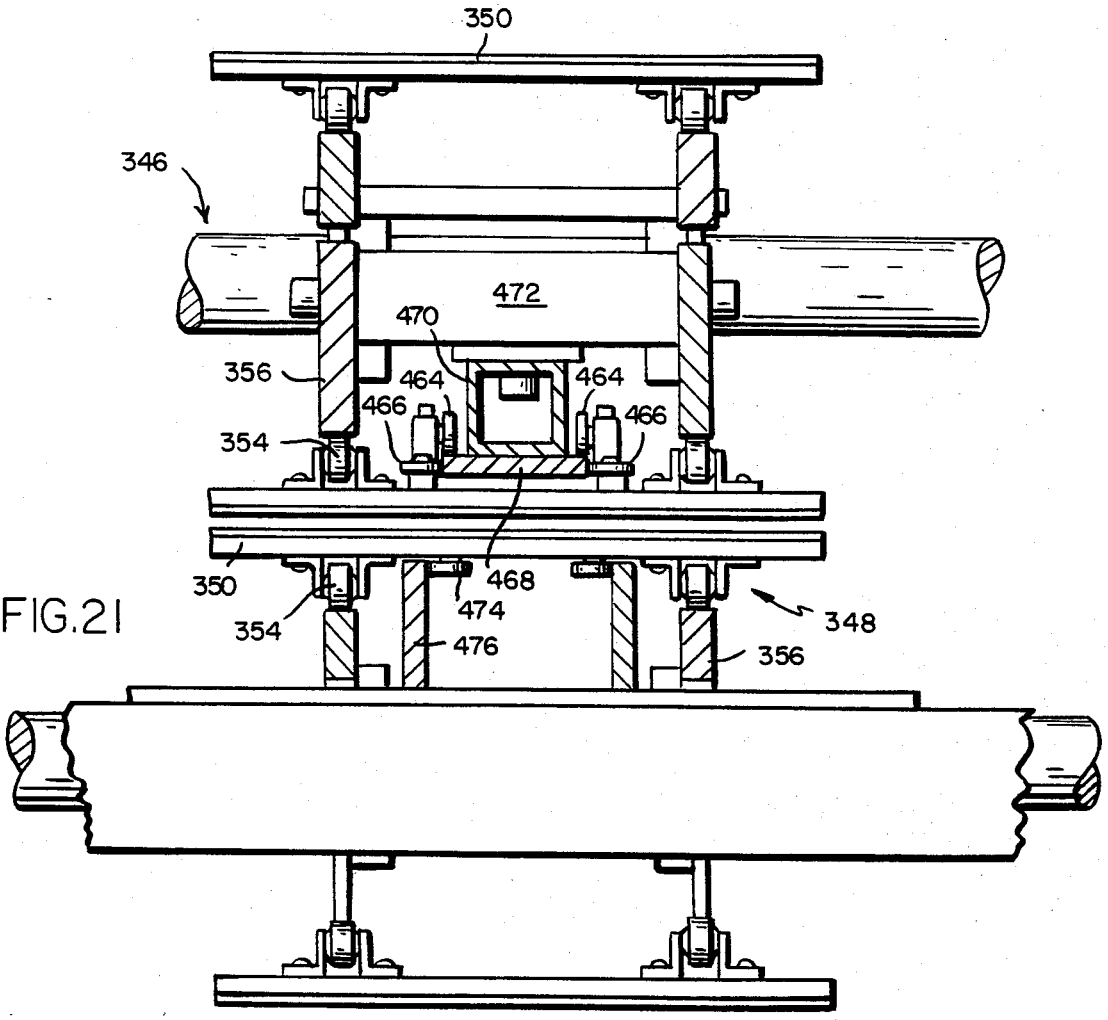
Figure 16:
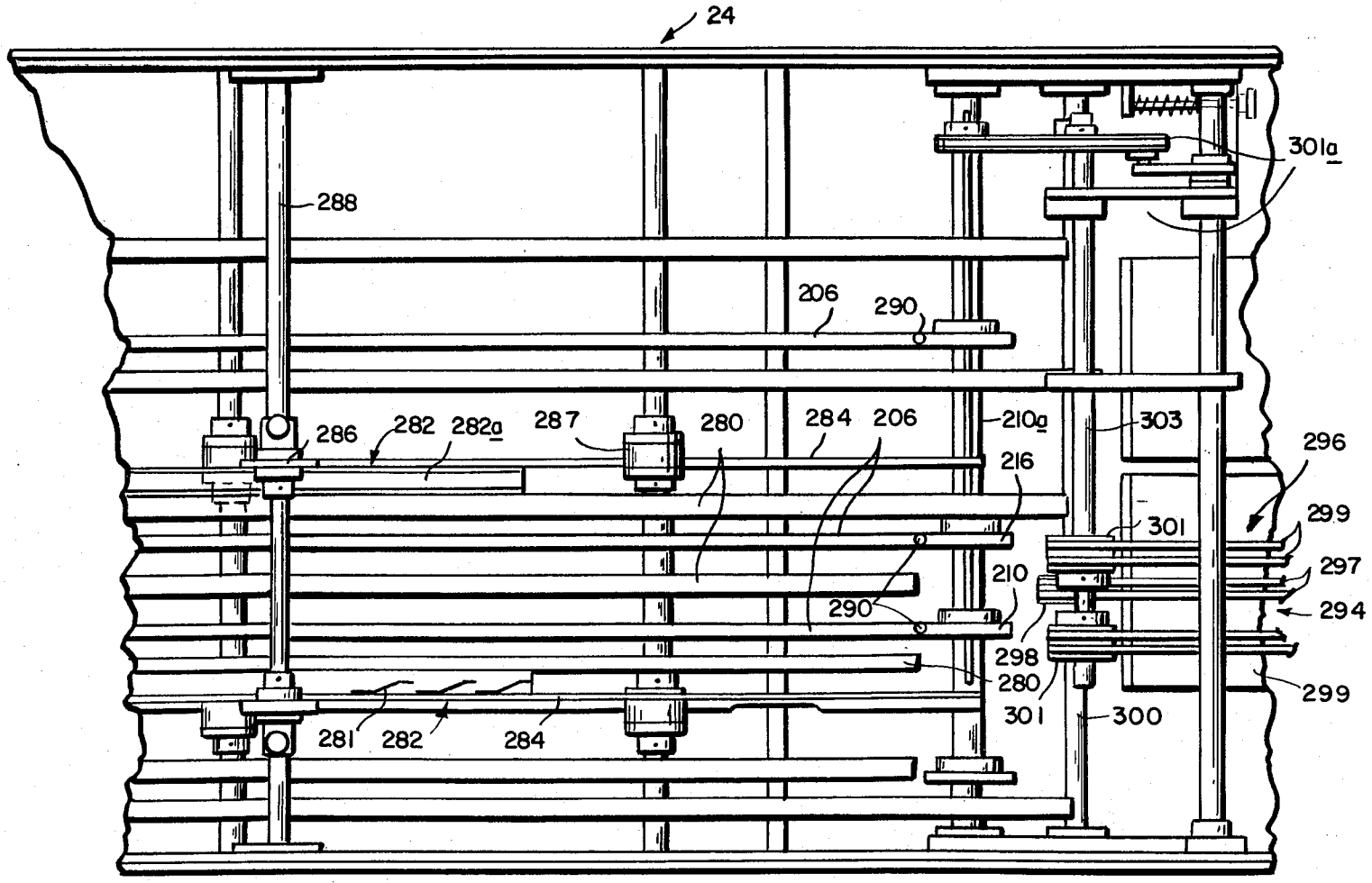
Figure 17:
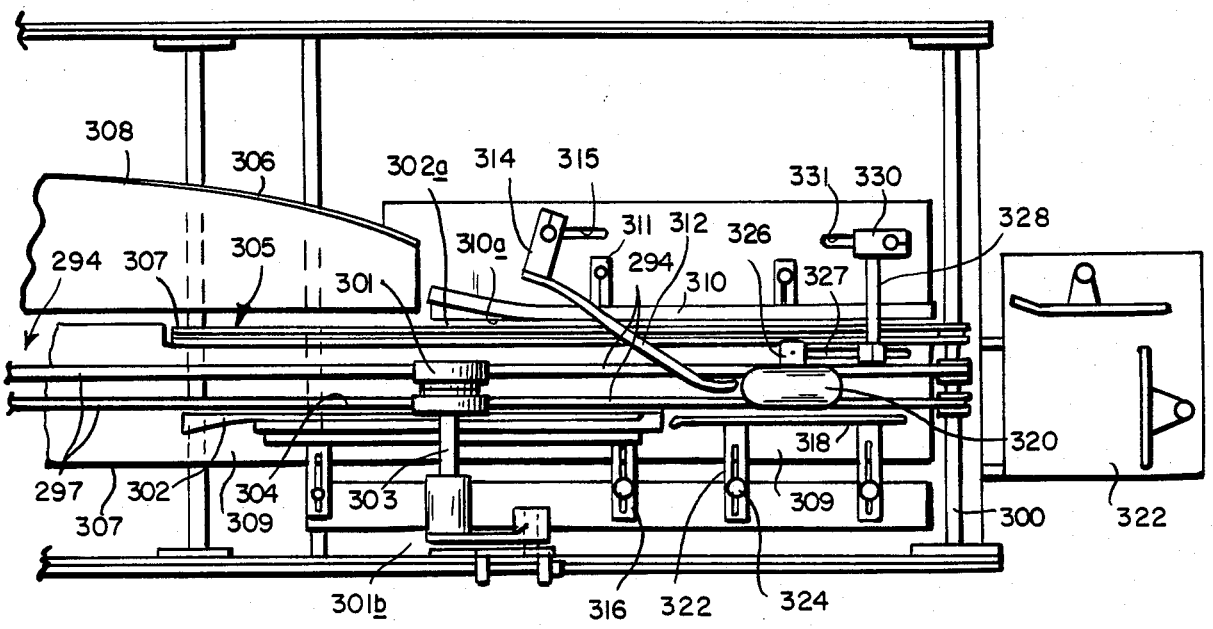
Figure 18:
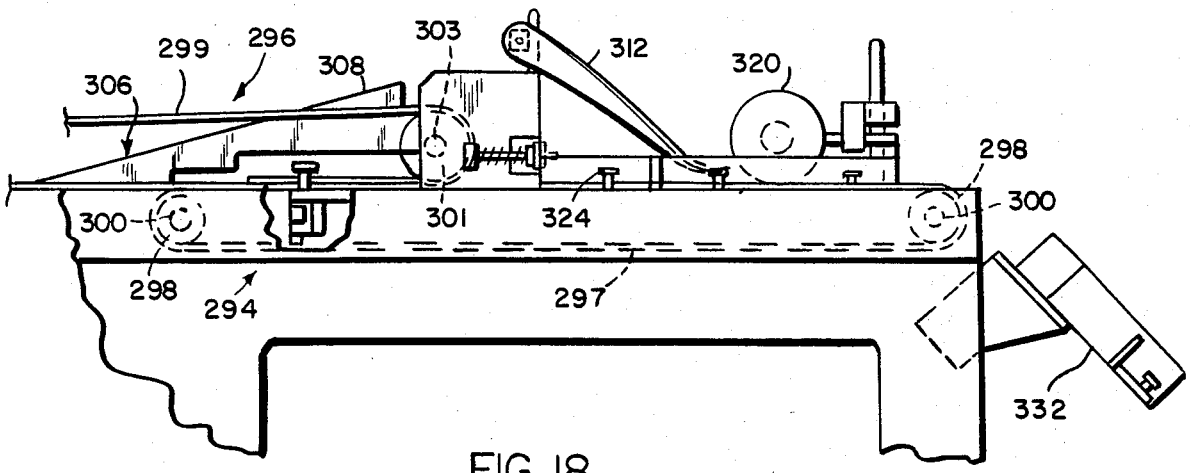
Figure 19:
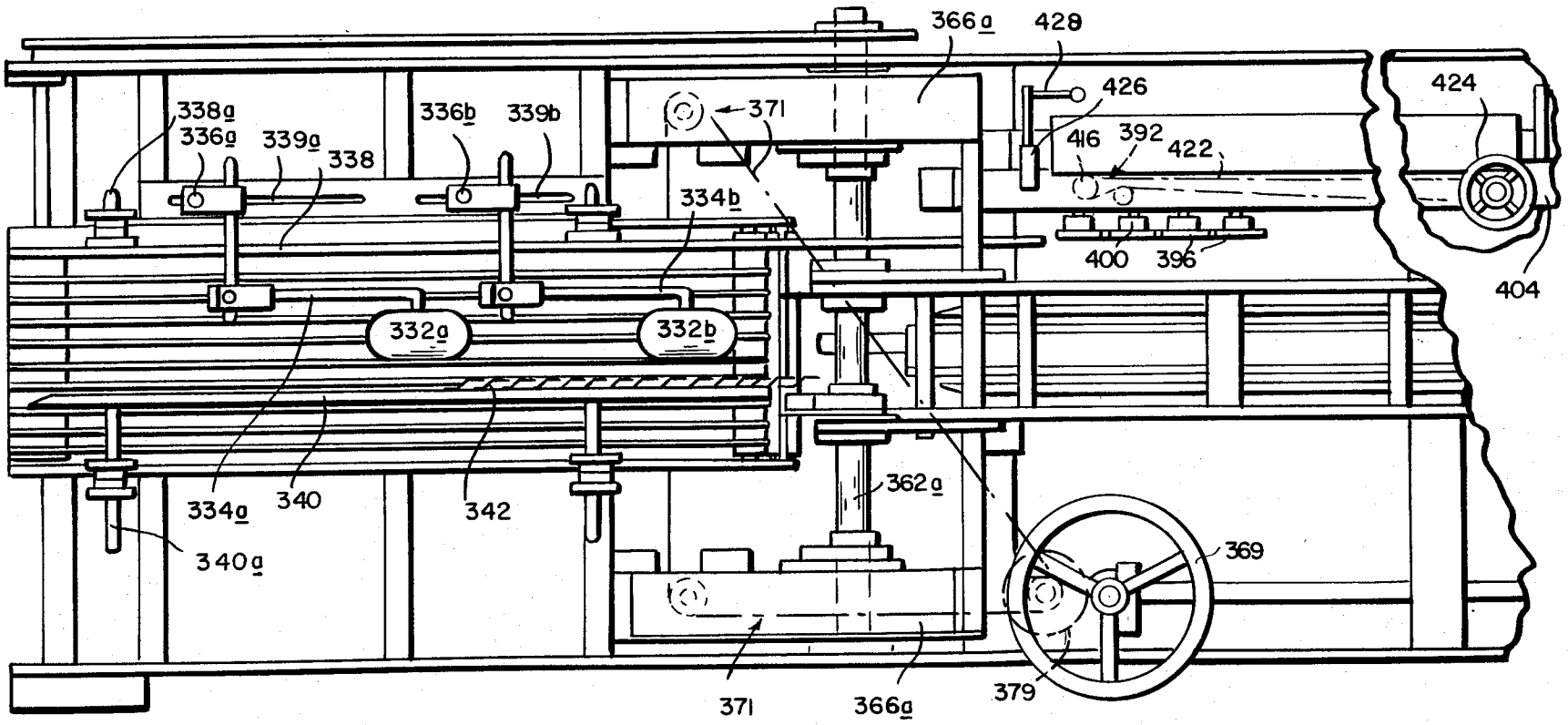
Figure 20:
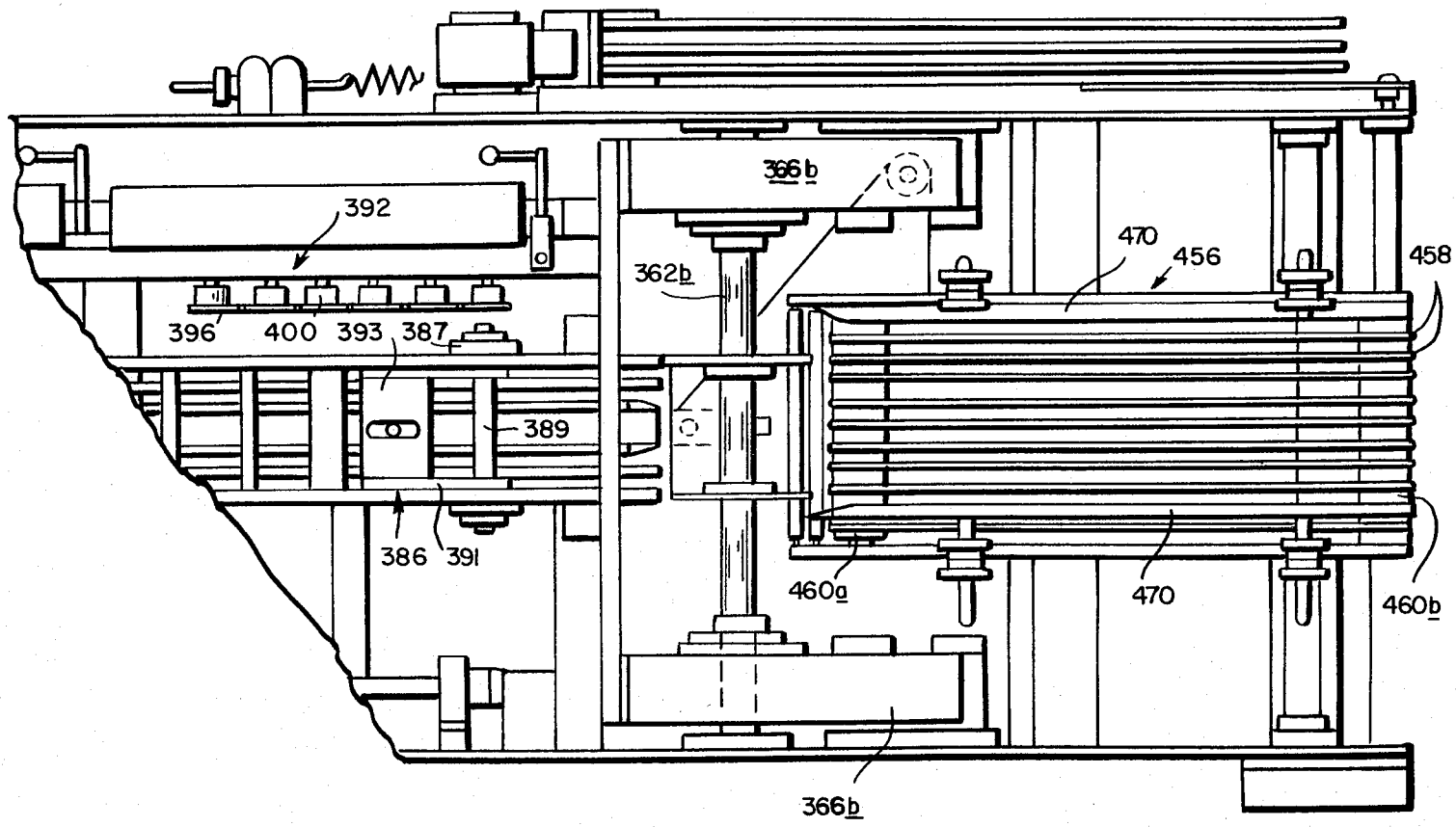
Figure 22:
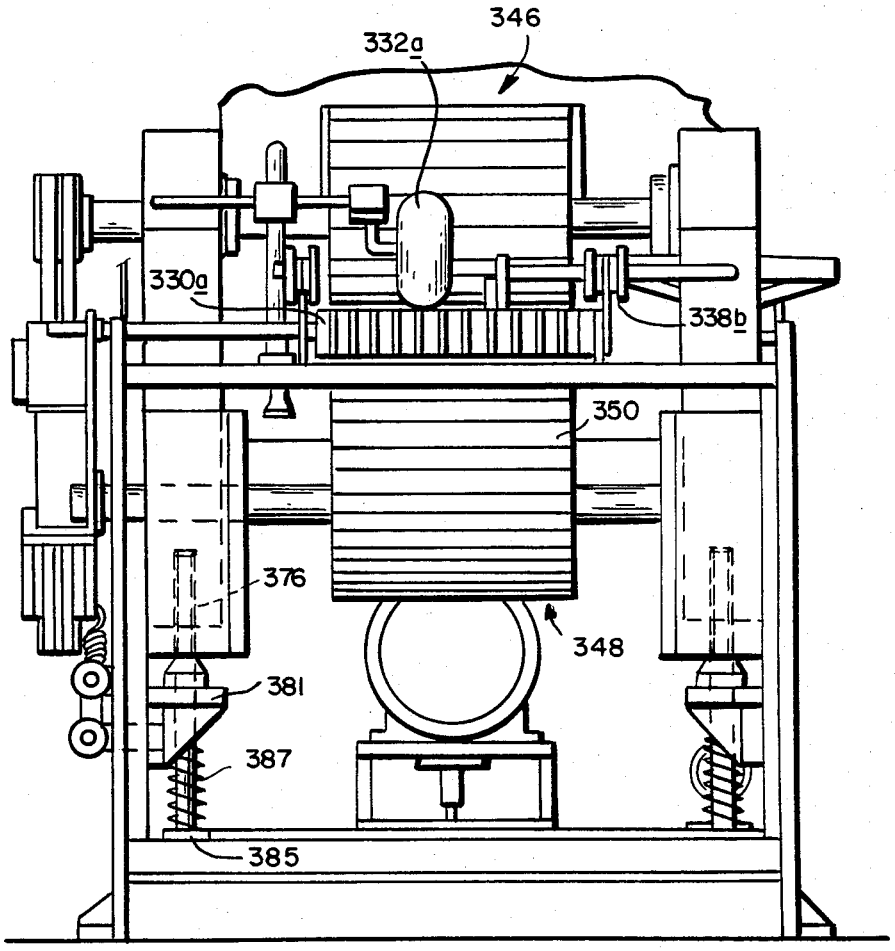
Figure 23:
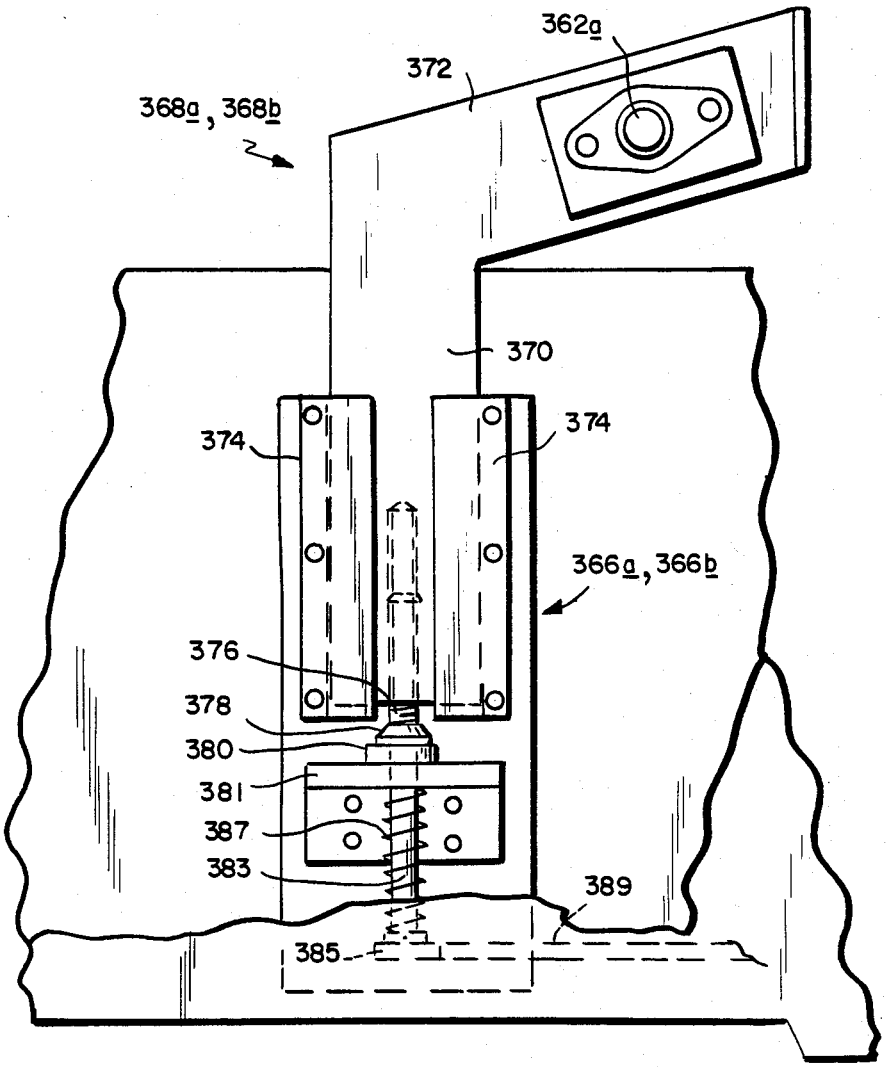
Figure 24:
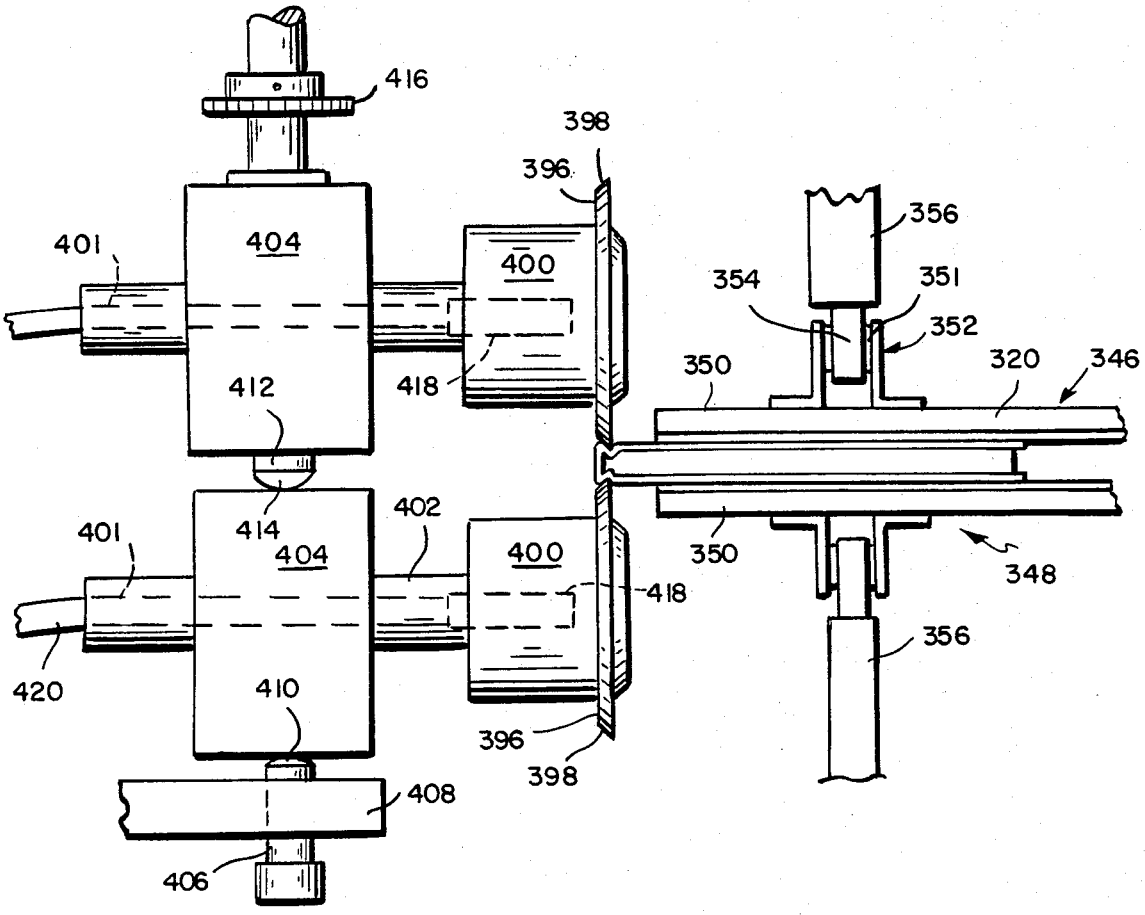

FIG. 3A diagrammatically illustrates the pressure-applying conveyors of the building-in section;

FIG. 4 is an elevation of the cover feeder of the casing-in machine;

FIG. 5 is an elevation taken from the right side of FIG. 4 with parts in section;

FIG. 6 is a plan view of the cover feeder with parts in section;

FIG. 6A is a view partly in section taken on the line 6A—6A of FIG. 6;

FIG. 6B is an elevation taken on the line 6B—6B of FIG. 6;

FIG. 7 is a plan view showing the cover heater and back former;

FIG. 8 is an elevation of FIG. 7;

FIG. 8A is a view partly in section taken on the line 8A—8A of FIG. 8;

FIG. 9 is a plan view of the glue-applying portion of the casing-in machine;

FIG. 10 is an elevation of FIG. 9;

FIG. 11 is a plan view of the book feeder of the casing-in section;

FIG. 12 is an elevation of the book feeding section shown in FIG. 11;

FIG. 13 is an enlarged plan view of the feed dog of the book feeding section;

FIG. 14 is a transverse section taken on the line 14—14 of FIG. 13;

FIG. 15 is a transverse section through the registering portion of the machine taken on the line 15—15 of FIG. 16;

FIG. 16 is a plan view of the registering section;

FIG. 17 is a plan view of the folding section;

FIG. 18 is an elevation of the folding section;

FIG. 19 is a plan view of approximately one-half of the building-in section;

FIG. 20 is a plan view of approximately the other half of the building-in section;

FIG. 21 is a section transversely of the building-in section;

FIG. 22 is an end elevation taken from the left end of FIG. 19;

FIG. 23 is a fragmentary elevation of the structure supporting the upper pressure-applying conveyor; and FIG. 24 is a fragmentary elevation showing portions of the pressure-applying conveyor belts and the hinge forming structure.

Figure 2:
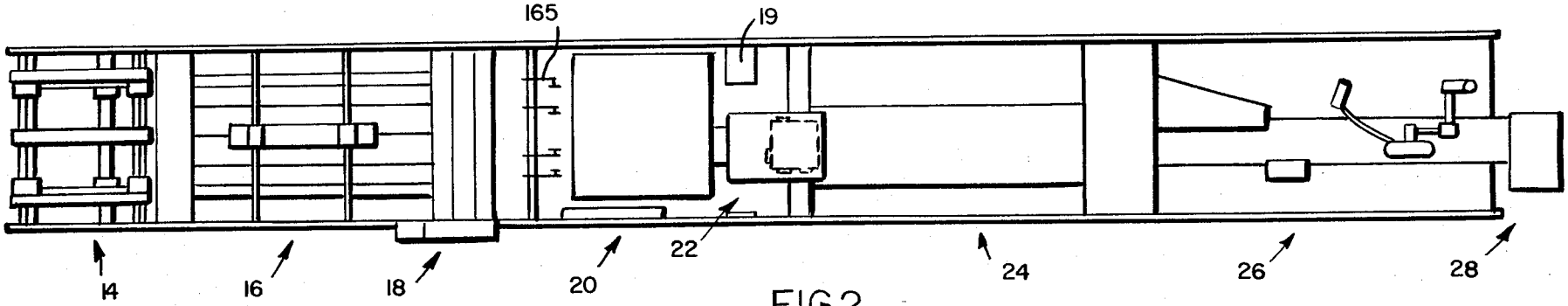
FIG. 2 is a plan view of FIG. 1.
Figure 1:
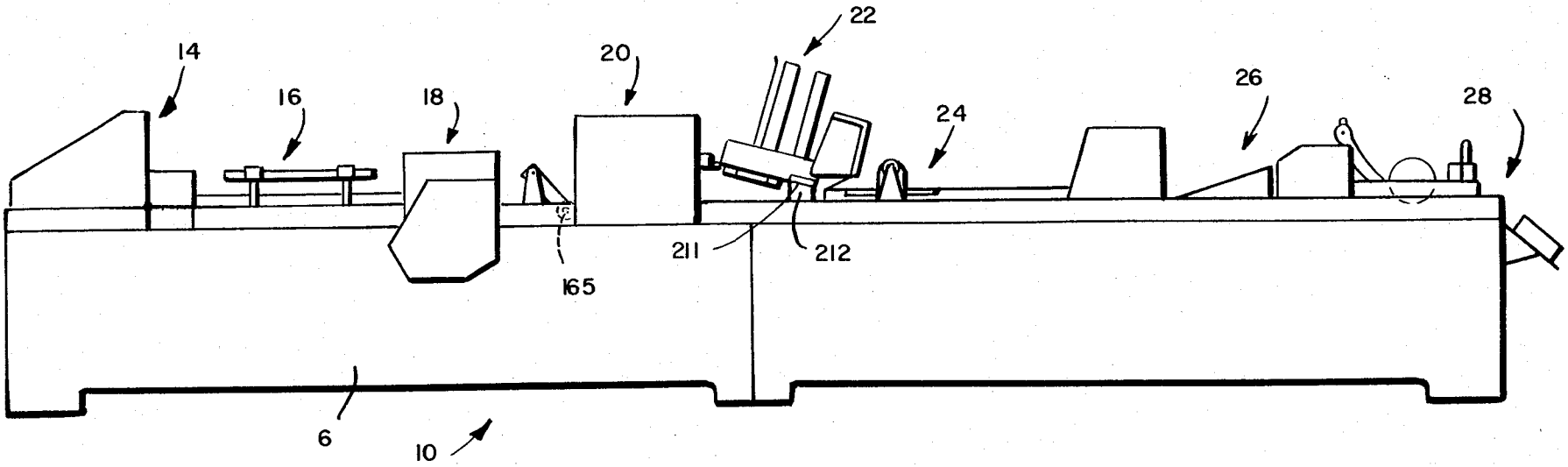
FIG. 1 is an elevation of the casing-in section of the machine.

Referring to the drawings, the book making apparatus of this invention comprises a casing-in section 10, FIGS. 1 and 2, and a a building-in section 12, FIG. 3.

In elevation, as shown in FIGS. 1 and 2, the casing-in section performs a series of successive operations which comprise in rectilinear arrangement at a station 14 a cover feeder, at a station 16 a cover heat lamp, at a station 18 a cover back former, at a station 20 an adhesive applicator or glue pot, at a station 22 a book feeder, at a station 24 a registration conveyor, at a station 26 a cover closer and, optionally, at a station 28 a book catcher. The building-in section 12 may optionally be substituted for station 28 and provides for forming the creases (hinges) at the back of the book, if creases are to be made, following assembly of the books with the covers as carried out on the casing-in machine 10 and comprises pressure-applying and creasing means 30 and 32, FIGS. 3 and 3A.

The casing-in section 10 provides for supporting a book cover spread open with its inside facing upwardly, heating at least the central portion of the book cover in the area where the back of the book will be attached, embossing the heated area to define fold lines at the back applying glue to the entire upwardly-facing side of the book, depositing a book, one flat side down, on the cover at one side of the back, aligning the cover and back and folding the cover at the other side of the back about the back of the book and onto the upwardly-facing side of the book. Books which are not to be subjected to building-in at the back are immediately discharged at station 28. When building-in is required, the covered book is further operated on the building-in section 12 to press the covers against the opposite faces of the book and to form hinges adjacent the back while subjecting the book to heat to set the adhesive and the hinges.

The foregoing operations are carried out by instrumentalities enumerated above mounted on rigid box frames 6 and 8 placed end-to-end in line so that the entire operation takes place continuous in one direction.

Referring specifically to station 14, FIGS. 4, 5 and 6, the cover feeder is mounted on the box frame 6 between spaced, parallel, longitudinally-extending plates 32—32, FIG. 5, the lower portions of which are fastened by bolts 34 to the side walls 36—36 of the box frame 6. The structure of the cover feeder is supported for movement in a horizontal plane by rollers 37 at its opposite sides confined between horizontally-positioned, vertically-spaced, parallel tracks 38—38 secured to the inner sides of the plates 32—32. The rollers 37 are mounted to the opposite ends of a transversely-positioned support bar 40 and rectilinear movement of the support bar forwardly and rearwardly is controlled by rollers 42—42 mounted to blocks 44—44 attached to the ends of the support bar 40 which have engagement with the inner sides of the upper tracks 38—38. The support bar is connected by a bifurcated bearing block 46 and pin 47 to the upper end of a lever arm 48. The lower end of the lever arm 48 is connected by a connecting rod 50 to an eccentrically-mounted pin 52 fixed to a disk 54 secured to one end of a shaft 56. The shaft 56 is mounted in bearings 58 and 60 bolted to a support 62 which, in turn, is bolted to the side wall 36 of the frame at the right side as shown in FIG. 5. A sprocket 64 is fixed to the shaft 56.

A chain 63 entrained about the sprocket 64 is driven from a main drive shaft, not shown, provides for effecting reciprocation of the support bar 40. The travel of the support bar 40 in reciprocation is adjustable by adjusting the effective length of the connecting rod 50 and, to this end, the lower end of the lever arm 48 is bifurcated to receive the connecting rod 50 and a clamp screw 66 is provided for clamping the bifurcations tight on the connecting rod 50.

The support bar 40, to be hereinafter referred to as the carriage 40, is designed to move one book cover at a time from the bottom of a stack of books supported between transversely-spaced, upstanding side walls 66—66, each of which comprises a side wall panel 68 parallel to the direction of movement and an end wall panel 70 at right angles to the direction of movement for engagement with the opposite edges of the cover and the leading edge of the cover, respectively, to hold the stack in position for feeding the lowermost cover of the stack forwardly. The end wall panels 70—70 are adjustably mounted by means of brackets 72—72 to the side wall panels 68—68, adjustment being provided by threaded screws 74—74 at the top which provide for vertical movement of the end wall panels 70—70 so as to position their lower ends 76—76 at a height from the supporting surface on which the lowermost cover rests corresponding to the thickness of the cover. Thumbscrews 78—78 are provided for fixing the end wall panels 70—70 in a selected position of adjustment.

As previously related, the carriage 40 provides for effecting forward movement of the lowermost cover from a stack supported between the side wall panels 68—68 through gaps between the lower ends 76—76 of the end wall panels 70—70 and the supports on which the stack rests and, to achieve such forward movement, there are provided transversely-spaced feeder blocks **80*a*—80*a* and an intermediate feeder block 80*b*, FIGS. 5, 6 and 6A. Each feeder block 80*a* comprises a part 82*a* slidable transversely on the carriage 40 and slidable in reciprocation in the direction of movement on a horizontally-disposed shaft 84*a*, the opposite ends of which are fixed in bearing blocks 86*a*—86*a* slidably mounted for movement transversely of the direction of movement on transversely-spaced, parallel shafts 88—88, the ends of the latter being fixed to the frame plates 36—36. Screws 90—90 are journaled at their ends in the side frame plates 36—36 and the bearing blocks 86*a*—86*a* contain threaded openings through which the screws 90—90 are threaded for effecting transverse movement of the bearing blocks 86*a*—86*a* in opposite directions to provide for adjusting the capacity of the cover feeder for covers of different width. The side wall panels 68—68 are mounted to the bearing blocks 86*a*—86*a* so as to be movable therewith for covers of different width. A sprocket 92, FIG. 6, is fixed to one end of each of the shafts of the screws 90—90, a chain 94 entrained about the sprockets and a hand wheel 96 fastened to one of the shafts provides for rotating the screws to adjust the bearing blocks 86*a*—86*a* relative to each other and, hence, the side walls 68—68 and feeder blocks 80*a*—80*a* relative to each other. The intermediate feeder block 80*b* is mounted on a shaft 84*b*, the opposite ends of which are fixed in bearing blocks 86*b*—86*b* and is movable forwardly and rearwardly, but not transversely. The bearing blocks 86*b*—86*b* are held centered by straddling collars 102—102** fixed to the screws.

Each of the feeder blocks **82*a*—82*a* and 82*b* has a wedge-shaped feed dog 104 fixed thereto which has an upwardly-inclined surface 106. The stacks of covers, when loaded into the feeder, rest on the planar upper surfaces of rails 114 with the rear edge of the lowermost cover engaged with the forward sides of the upwardly-projecting feed dogs 106 so that when the carriage 40** moves forwardly, the feed dogs strip the lowermost cover from the bottom of the stack and move it forwardly.

During the book making operation, the carriage 40 is reciprocated at a rate which is synchronized with the remaining operations of the machine to deliver covers one at a time for receiving a book fill for covering. However, there are times when it is desirable to discontinue the feed of book covers without stopping the entire machine. Accordingly, there is provided means 108—108, FIG. 4, for lifting the entire stack of covers to a level such that the feeder blocks **82*a*—82*a* and 82*b* merely reciprocate back and forth between the lower end of the stack without stripping a cover from the bottom. The means 108—108 comprise crank arms 110—110 provided with arms 110*a*,110*b* pivotally mounted at 112—112 to A—A or cylinder assemblies 116—116. The upper ends of the arm 110*b* are connected by pin and slot means 117—117 to air-operated piston and cylinder assemblies 116—116, the latter being mounted to the inner sides of the side wall panels 68—68**.

Stack retainer panels 113—113 are mounted transversely of the hopper to the inner sides of the side walls 68 for transverse movement with the side walls and for adjustment forwardly and rearwardly relative to the end wall panels 70—70 according to the length of the covers. The retainer panels 113—113 are mounted to the cylinder assemblies 116—116, shown at B—B FIG. 6.

The book covers are delivered forwardly from the station 14 to station 16 one at a time by a pair of horizontal feed rolls 118,120, FIGS. 7 and 8, and from thence onto the horizontal run of an endless chain conveyor 122 at that station. The feed rollers 118 and 120 are mounted in bearings at their ends, FIG. 8, between spaced, parallel mounting plates 123—123 fastened to the box frame. The bearings for the lower feed roll 118 are fixed, while those for the upper feed roll 112 are spring-biased toward the lower feed roll by coil springs 127—127, the pressure of which can be adjusted by screws 128—128. Meshing gears **124*a*,124*b* and 124*c* provide for driving the lower feed roll 118, the gear 124*c* being fixed to the drive shaft of the conveyor 122. The gear 124*c* is driven from the main drive shaft by a chain 125 entrained about a sprocket 127.1**.

The chain conveyor 122 is positioned forwardly of the feed rolls 118,120 in the direction of movement and comprises transversely-spaced, parallel, endless chains 130 entrained about sprockets 132 fixed to transversely-positioned shafts 134—134. There are four such sprockets and four chains. To provide for a smooth transition of the covers from the feed rolls 118,120, spaced, parallel belts 136 are positioned between the conveyor chains 130 with their ends entrained about the feed roll 118 within grooves therein and about a support member **136*a*. The belts 136 are smooth, desirably, made of plastic. The chains 130 have longitudinally-spaced feed dogs 131 therein which are advanced in timed relation to the forward feeding of the covers from the cover feeder at station 14 to engage the trailing edge of a cover discharged from the feed rolls and advance it forwardly. At the station 16, a heater 135 is mounted above the conveyor 122 on transverse bars 137—137, the opposite ends of which are supported by uprights 138—138 attached to the box frame. Any conventional radiant-type heater may be used and, desirably, it is selected to be of a size long enough in the direction of travel to expose at least the entire central portion of the covers to heat during its travel along the conveyor to condition the material of the cover for the subsequent embossing operation. The conveyor 122 transfers the covers from the heating station to the station 18 where the back is embossed to provide fold lines at the back spaced apart a distance corresponding to the thickness of the back of the book to be covered. At this station, for this purpose, there is an assembly of rolls mounted transversely of the frame between spaced, parallel supporting plates 142—142, FIGS. 7 and 8**, fixed to the box frame.

The assembly of rolls, FIG. 7, comprises first feed rolls comprising a lower feed roll **144*a* and four upper feed rolls 144*b*, second feed rolls comprising a lower feed roll 146*a* and four upper feed rolls 146*b*, and intermediate the first and second feed rolls two lower creasing rolls 145*a*—145*a* flanked at opposite sides by four lower feed rolls 147*a* and two upper creasing rolls 145*b*—145*b* flanked at opposite sides by four upper feed rolls 147*b*. The creasing rolls 145*a*—145*a* each have a peripheral rib 150 and the creasing rolls 145*b*—145*b* each have a peripheral groove 152. As the cover is advanced between the creasing rolls 145*a*–145*a*, 145*b*—145*b* by the feed rolls, the central portion of the cover which has just been heated is deformed to provide spaced, parallel creases 156—156 which define the width of the book. The lower feeding and creasing rolls are journaled in fixed bearings and the upper in movable bearings spring-biased toward the fixed bearings by means of springs 140, the pressure of which can be adjusted by screws 142. In order to guide the covers as they are moved forwardly by the conveyor 122 into the creasing rolls, there are provided spaced, parallel supports 158—158, FIG. 7, each comprising a horizontal supporting surface 160 and a vertical guiding surface 162. The supports 158—158 are mounted on threaded sleeves 134.1—134.1 for transverse adjustment relative to each other. Set screws 134*a* provide for fixing the sleeves at a predetermined spacing and threaded collars 134*b* on the sleeves provide for positioning the supports on the sleeves. Flexible spring fingers 159 are secured to the inner side of the guiding surface 162 to cushion the guiding action. The shaft 134 at the leading end of the conveyor 122 has fixed to it a gear 139*a* which drives the feed rolls and creasing rolls by way of a series of meshing gears 139*b*–*f***.

From the station 18, the creased back is moved by means of a conveyor 166, FIGS. 7, 9 and 10, to the station 20 for application of glue. The conveyor 166 comprises a plurality of spaced, parallel endless belts 168, FIGS. 7, 9 and 10, entrained at one end about the lower feed roll **146*a* within peripheral grooves 170 therein and at their opposite ends about a roll 172 within grooves 174. The conveyor 166 is driven by the lower feed roll 146*a***.

At the station 20, FIGS. 9 and 10, there is a glue-applying assembly and a conveyor 176 comprised of a plurality of spaced, parallel endless belts 178 entrained at one end about a grooved roller 180 adjacent to and parallel to the roller 172 and a roller 182. A pair of spaced, parallel supporting plates 184—184 are fastened to the box frame of the machine at opposite sides of the conveyor 178 and between these supporting plates, there are journaled an applicator roll 185 which has substantial tangential relation with the conveyor 176, two transfer rolls 186 and 188 and a pickup roll 190. The applicator roll 185 is tangentially engaged with the transfer roll 186, transfer roll 186 is tangential with the transfer roll and the transfer roll 188 is in tangential engagement with the pickup roll 190. These rolls extend transversely of the box frame and are sufficiently wide to apply glue to the entire width of the back as it is moved from the conveyor 166 onto the conveyor 178 and by the latter beyond the glue-applying applicator roll 185.

Glue is supplied to the pickup roll 190 from a tray 192 which is supported on a platform 194 mounted for movement from a position beneath the pickup roll to a position forwardly thereof. At its position beneath the pickup roll 190, the lower portion of the pickup roll dips into the glue in the tray 192 and rotation of the pickup roll removes glue from the tray and transfers it by way of the transfer rolls 188 and 186 to the applicator roll 185. Articulated linkage comprising links 196, 198 and 200 connected to an air-operated piston and cylinder assembly 202 provide for moving the tray into and out of position beneath the pickup roll. The outer position of the tray is provided to enable removing the tray for cleaning and refilling with glue. The pickup roll 190 and roll 180 are driven from the main shaft, not shown, by a chain 181 and sprocket 191.

Between the creasing rolls and the glue-applying rolls, there are hold-down means comprising rollers 165, FIG. 1, mounted on arms positioned transversely of the conveyor 166 with the rollers engaged with the belts. The arms are positioned horizontally with respect to the belts of the conveyor to hold the cover flat as it is moved toward the next station.

From the glue-applying station 20, the glue-coated cover is moved to station 22 where a book is dropped onto the cover by a book feeder at this station. A conveyor 204, FIGS. 9, 10 and 11, comprising a plurality of transversely-spaced, parallel, endless chains 206 entrained at one end about sprockets 208 fixed to a shaft **208*a* and at their opposite ends about sprockets 210 fixed to a shaft 210*a*, FIG. 16, move the glue-coated covers into position beneath the book feeder at the station 22. The book feeder, FIGS. 11 to 14, is comprised of spaced, parallel frame members 209—209 fastened to a support member 211 supported transversely of the box frame on spaced, parallel uprights 212—212. The frame members 209—209 are supported by the support member 211 in a forwardly and downwardly-inclined position as shown in FIG. 1 and between the supporting members 209—209 there is a supporting plate 214, FIG. 11, on which the stacked books to be deposited one at a time on the conveyor therebelow is supported. The supporting plate 214 contains an opening 216 within which there is mounted for reciprocal movement a feed block 218, FIG. 14. The feed block 218 is mounted on a carriage 220, FIG. 14, supported by rollers 222—222 and guided by rollers 223—223 between the transversely-spaced, horizontally-positioned tracks 224—224. A piston and cylinder assembly 226, FIG. 12, connected to the carriage provides for reciprocal movement thereof. At the forward end of the carriage 220, there is a feed dog 228 which, by engagement with the trailing edge of a book supported in the magazine, will move the lowermost book forwardly. The longitudinal position of the feed dog 228 on the carriage 220 is adjustable by means of bolt and slot means 221,223. A stack of books (inserts) is maintained in position on the supporting plate 214 by transversely-spaced, parallel stack plates 230, FIGS. 11 and 12, two at one side and one at the other, parallel to the direction of movement and longitudinally-spaced stack plates 232,234 at right angles to the direction of movement. The stack plates provide aligning surfaces parallel to the direction of movement and aligning surfaces at right angles to the direction of movement. The stack plates 230—230 at the near side of the machine as shown in FIG. 11 are adjustable transversely of the frame relative to the stack plate 230 at the far side and the stack plate 232 is adjustable longitudinally of the machine. As shown, these adjustments are provided by angles 240 which the stack plates are fixed and screws 242 threaded through the angles into the supporting plate 214 within slots 244 and 246. The stack plate 234 extends from side to side and is supported at its opposite ends by spaced, parallel frame members 238—238, FIGS. 11 and 12, which, in turn, are fastened to the side frame members 209—209 forwarding of the stack plates 230. There are means for adjusting the stack plate 234 heightwise so that the lower edge thereof is at a level corresponding to the thickness of the book above the supporting plate 214. Screws 240 provide for fixing the stack plate 234 in its adjusted position. Forwardly of the stack plate 234, there are bearing plates 242—242 bolted to the side plates 209—209, between which there are mounted upper and lower feed rolls 244 and 246 for engaging the leading edge of a book pushed forwardly beneath the lower edge of the stack plate 234 by the feed dog 228 and depositing it on a cover resting on the conveyor therebelow. The lower feed roll 246 is journaled in fixed bearings and the upper feed roll 244 is mounted at the distal ends of a pair of bearing arms 248—248, the proximal ends of which are pivotally mounted on a shaft 250 fixed between the bearing plates 242—242. As thus mounted, the upper feed roll 244 can yield relative to the lower feed roll 246 for books of different thickness. Screws 252—252 rotatably coupled to blocks 254—254 mounted to the inner sides of the side plates 242—242 provide for applying variable resistance to displacement of the upper feed roll by means of coil springs 256—256 mounted thereon between the blocks 254—254 and blocks 258—258 also mounted to the inside of the plates 242—242 and screw threaded thumbnuts 260—260 threaded onto the screws against the blocks 258—258. A chain 262 entrained about sprockets 261,263 on the upper and lower rolls and about sprockets 266 and 268 journaled on the inside of the bearing plate 242 provide for effecting rotation of the feed rolls. The sprocket 268 is mounted to the distal end of an arm 270 pivotally mounted on the shaft 250. The distal end of the arm 270 is provided with a spring 272 for biasing the sprocket in a direction to maintain tension in the drive chain. The lower feed roll 246 is driven by chains 246*a*,246*b*** from the main drive shaft.

A detector 19 (FIG. 2) in the form of a photocell is positioned on the box frame to detect passage of a cover on the conveyor 204 below the feeder to cause actuation of the piston and cylinder assembly 226 to eject a book from the bottom of the pile forwardly between the feed rolls 224,246 and to drive the latter so as to deposit the book onto the cover therebelow.

When a book insert is dropped onto a cover resting on the conveyor 204 therebelow, it is moved forwardly together with the cover through the station 24 where registration of the books and covers take place. For this purpose, book guides 282—282, FIGS. 15 and 16, are mounted on hangers 286—286 supported from a transverse shaft 288 for transverse adjustment thereon relative to each other. The back guides provide horizontal and vertical surfaces **282*a* and 282*b* for supporting and guiding the books. Cover guides 284—284 are mounted on supports 287—287 which are, in turn, mounted for transverse adjustment on a transverse shaft 289. The covers are supported by rails 280. The cover guides provide vertical surfaces 284*a* for guiding. The conveyor chains 206 which are parallel to the guides have feed dogs 290, FIG. 15, with offset surfaces 292 and 294 which, by engagement with the trailing edge of the book and the trailing edge of the cover, respectively, position, that is, center the book on the cover with the margins at the leading and trailing edges offset. The cover is supported during this movement by transversely-spaced support rails 280, the supporting surfaces 280*a* of which are transversely arcuate. There are spring fingers 281 at the inner side of the rail 280 at the near side for yieldably pushing the back of the book against the rail 280 at the far side. The hangers are vertically adjustable by means of eccentrics 288.1—288.1**.

At this point in the progress of the cover and book, the cover lays spread open inside facing upwardly with the back seam or back of the cover aligned with the direction of movement and with a book deposited on the cover at one side of the book.

The cover and book are moved forwardly by the registration conveyor 204 to station 26 where the back of the cover and the cover panel laterally of the book is folded about the book. At station 26, there are spaced, parallel overlapping conveyors 294 and 296, FIG. 16. The conveyor 294 comprises spaced, parallel, endless belts 297 entrained about rolls 298 fixed to shafts 300, the end of which are journaled in the opposite sides of the frame. The conveyor 296 comprises spaced, parallel, endless belts 299 entrained about rollers 301 fixed to a shaft 303 with the lower runs parallel to the upper run of the belt 297. In addition, there is a conveyor 305, FIG. 17, entrained about a belt roll 307 at one end and about the belt roll 298 at the other end, the upper runs of which are at the same level as the upper runs of the belts 297. The shafts 303 are supported by lever systems **301*a*,301*b* for adjustment heightwise of the conveyor 294. A support 307 providing a flat supporting surface 309 underlies the upper runs of the conveyors 294 and 305**.

At the near side of the conveyors 294 and 296, as seen in FIG. 17, there is an edge guide plate 302 which runs parallel to the direction of movement and which provides a vertical surface 304 for engagement with the edge of the book as it is moved through the folding station to maintain rectilinear movement. At the opposite side, there is a first folding blade 306 which has an upwardly and inwardly-inclined edge 308 arranged by engagement with the underside of the cover to lift the cover at that side to a position such that the back portion of the cover becomes engaged between the back of the book and an edge guide 310 parallel to the edge guide 302 which provides a vertical surface 310*a*. The vertical surface 310*a* serves to press the uplifted embossed portion of the cover against the back or spine of the book or fill. As the assembly moves forwardly of the terminal end of the upper conveyor 296 which, as shown, terminates at the forward end of the folding blade 306, a second folding blade 312 folds the cover panel at the distal edge of the embossed back of the cover over onto the upwardly-facing side of the book. The folding blade 312 is supported diagonally above the path of movement and inclined downwardly and across the path of movement. The edge guide 310 is adjustable transversely by screw and slot means 311. The upper end of the folding blade 312 is adjustably supported by means of a bracket member 314 and screw and slot means 315 longitudinally in the direction of movement. The edge guide 302 is mounted for adjustment transversely by means of screw and slot means 316. Beyond the edge guide 302 at the near side, there is an edge guide 318 and a pressure-applying roll 320. The edge guide 318 is adjustable transversely by means of screw and slot means 322. The roller 320 herein shown as a pneumatic tire is rotatably mounted to a shaft 326 mounted on an arm 327, the latter being fixed to a shaft 328 which, in turn, is fixed to a bracket 330. The bracket 330 is longitudinally adjustable by means of a screw and slot means 331.

A book assembled by the aforesaid means may be delivered off the end of the conveyor 297 directly onto a discharge apron 332. However, for most purposes, it is desirable to move the assembly on to the building-in section 12 to apply pressure to the assembled book for a further period of time and especially to form up the cover panel hinges. The building-in section 12, FIGS. 3, 3A, 19, 20, 21 and 22, is supported on the frame 8 and comprises essentially a first conveyor 326 comprising spaced, parallel conveyor cables 328 entrained at one end about a roller 330*a* and at the other end about a roller 330*b*. The covered book is moved forwardly by the first conveyor 326 beneath longitudinally-spaced, universally-adjustable, pressure-applying rolls 332*a*,332*b* in the form of rubber tires supported by arms 334*a*,334*b* mounted by means of clamp blocks 334*c* on posts 336*b*,336*b* midway between spaced, parallel edge guides 338,340, FIGS. 19 and 20, for engagement, respectively, with the back and front edges of the book. The edge guide 340 has yieldable spring fingers 342 on its inner side so so as to yieldably press the book toward the guide 338 for precise registration. The posts 336*a*,336*b* can be adjusted longitudinally in slots 339*a*,339*b* and the arms 334*a*,334*b* can be adjusted transversely. The edge guides 338,340 are micro-adjustable transversely by threaded means 338*a*,340*c*. The conveyor 326 advances the perfectly registered covered book between a pair of upper and lower conveyors 346 and 348 entrained at their ends about sprockets 342*a*,342*b* and 343*a*,343*b*. The conveyor 326 advances the covered book between the conveyor belts 346 and 348. Each conveyor belt 346,348 is comprised of a plurality of transversely-positioned pressure-applying plates 350, FIGS. 22 and 24, connected by studs 352 to conveyor chains 351 mounted on the sprockets for applying pressure to the book being moved between them. The links of the chain are provided with rollers 354 which ride on rails 356 and, by adjusting the spacing of the rails, the pressure on the assembled book as it passes between the pressure-applying plates can be adjusted. The sprockets 342*a*,342*b*, about which the opposite ends of the conveyor 348 at the lower side are entrained are fixed to shafts 358*a*,358*b*, the opposite ends of which are supported in bearings fixed to the opposite sides of the frame. Sprockets 343*a* and 343*b* about which are entrained the ends of the upper conveyor 346 are mounted on shafts 362*a* and 326*b*, the opposite ends of which are journaled in supporting assemblies 366*a*,366*b*, FIG. 23, which provide for applying downward pressure to the upper conveyor belt while permitting the upper conveyor belt to yield upwardly as the assembled books pass between the pressure-applying plates of which the upper and lower conveyors are comprised. Each assembly, there being one at each end, comprise two angle members 368*a*—368*a* and 368*b*—368*b*, one at each side of the machine. Each angle member 368*a* and 368*b* has a vertical limb 370, FIG. 23, and an inclined limb 372. The vertical limb 370 is slidingly mounted between guides 374—374 fastened to the side wall of the frame and has threaded into its lower end a screw 376 provided with a head 378 which is yieldably held against a thrust plate 380 mounted to a bracket 381 by means of a shaft 383 for vertical and rotational movement. At the lower end of the shaft 383, there is a sprocket 385 and between the bracket 381 and the sprocket, there is a coiled spring 387. A chain 389 entrained about the sprocket provides for raising and lowering the shaft 383 which, in turn, enables raising and lowering the supporting assemblies 366*a*,366*b* to adjust the spacing between the upper and lower conveyor belts. A hand wheel 369 and kinematic means 371 and 379 provide for rotating the sprockets 385 to effect adjustment. The upper belt 346, as shown in FIG. 21, is supported by rollers 464—464 on a longitudinally-extending supporting rail 468 which, in turn, is supported by bracket members 470 on an upper cross brace 472 and is guided by rollers 466—466 which have contact with the opposite sides of the rail 468, thus supporting the conveyor throughout its entire length in a uniformly horizontal position with respect to the lower conveyor. The lower conveyor 348 is, in turn, guided by rollers 474—474 which have engagement with spaced, parallel, longitudinally-extending rails 476—476.

The upper conveyor 346 is held in tension of a chain tensioner 386, FIGS. 3 and 3A, over which a portion of the upper run of the upper conveyor is entrained just before it passes over the end supporting sprockets 343*b*—343*b*. The tensioner comprises sprockets 387—387 over which the chains pass mounted on a shaft 389 which, in turn, is supported between arms 391—391 mounted to a longitudinally-adjustable bracket plate 393 which enables adjusting the position of the sprockets and, hence, the tension in the conveyor. Tension is maintaine in the lower belt 348 by idlers 388—388 over which the lower run of the lower conveyor passes which are spring-biased by means of a spring 390—390 in a direction to maintain tension in the conveyor.

As the book assemblies are moved along by and between the conveyors 346 and 348, the hinges are pressed into the upper and lower cover panels adjacent the back or spine of the book at a pressure supplemented by heating such as to provide permanently embossed hinges in the front and back cover panels of the back, FIG. 24. This is achieved by providing upper and lower rows 392,394 of heated embossing disks, FIGS. 3, 19 and 20. Each row comprises a plurality of circular disks 396, FIGS. 20 and 24, having beveled peripheral edges 398. These disks 396 are fixed to circular hubs 400 mounted on shafts 402 which, in turn, are mounted in vertically-spaced, parallel relation transversely of the frame in a position such that the disks 396—396 will have tangential engagement with the front and back sides of a book supported between the conveyors. The shafts 402 are rotatably mounted in vertically-aligned upper and lower rails 404. The lower rail is vertically adjustable by means of threaded screws 406 threaded through supporting structure 408 on the side rails with an end 40 bearing against the lower side of the lower rail. The upper rail is also vertically adjustable and is yieldably held at a predetermined spacing with respect to the lower rail by a spacer element 412 threaded through the rail, the lower end 414 of which rests on the lower rail and the upper end of which is provided with a sprocket 416 by means of which its position may be extended or retracted relative to the lower rail to change the spacing between disks 396. The disks 396 are free-wheeling, that is, not driven. Their rotation is obtained solely through their frictional engagement with the cover of the book as the latter is being moved by the conveyors. To make the creases, that is, the hinge lines, permanent, the disks 396 are heated and this is achieved by inserting a heating element 418 in each of the hubs 400 and providing the shaft 402 with axial passages 401 for receiving wiring 420.

A chain 422 entrained about the sprockets 416 provides for raising and lowering the upper rail 404. A hand wheel 424 provides for effecting movement of the chain. Locking maladjustment of the rails is provided by screws 426 having handles 428 by means of which they may be rotated.

The drive for the conveyors is provided by a motor M, FIG. 3, mounted within the frame having a drive shaft 430 on which there is mounted a pulley 432. A belt 434 transmits rotation of the shaft 430 to a pulley 436 rotatably mounted on a shaft 438. A belt 440 entrained about the pulley 436, a pulley 442 fixed to the shaft **362*b*, a pulley 444 fixed to the shaft 342*b*, an idler 448 supported at one end of an arm 450 and back to the pulley 436 provides for driving the conveyors 346, 348. Springs 452 bias the arms 450** in a direction to maintain tension in the drive.

The completed book is discharged from between the pressure-applying conveyors onto a conveyor 456 comprised of a plurality of transversely-spaced, endless belts 458 entrained about pulleys **460*a*,460*b*. Transversely adjustable edge guides 470 are provided at opposite ends of the conveyor 456. The pulley 460*a* is driven by a belt 462 entrained at one end about the pulley 460*a* and at the other end about a pulley fixed to the sprocket 342*b*. The shaft 342*b* is driven by a belt 440**.

The uninterrupted rectilinear movement achieved by arranging the instrumentalities described above enables covering books at a rate of approximately 120 books per minute.

It should be understood that the present disclosure is for the purpose of illustration only and includes all modifications or improvements which fall within the scope of the appended claims.

What is claimed is:

1. A high speed casing-in and building machine for joining book covers to inserts to make a book, said covers initially being without fold line, comprising:

in line means for depositing book covers without hinges and fold lines one at a time in a horizontal position with their insides facing upwardly for movement along a predetermined path, means for heating the upwardly facing side of said cover, means for embossing the cover with longitudinally-disposed, spaced, parallel depressions constituting fold lines formed at a spacing corresponding to the thickness of the insert, means for applying adhesive to the entire upwardly-facing surface of each cover, means for depositing an insert, one broad side down, upon the upwardly facing surface of the cover at one side of a longitudinal center line, means for positioning the insert on the cover at the one side of the center line at a distance therefrom corresponding to one-half the thickness of the insert, and means for wrapping the portion of the cover extending laterally from the insert about the back of the insert and into engagement with the upwardly-facing broad side of the insert.

2. Apparatus according to claim 1 comprising means for moving the cover along said predetermined path.

3. Apparatus according to claim 1 comprising means for moving the cover along said predetermined path and means for detecting the presence of a cover at a predetermined position along said path, said last-named means being operable to cause the means for depositing an insert on a cover to deposit an insert on the cover at said predetermined position.

4. Apparatus according to claim 1 and further comprising means for forming hinges in said cover panels at opposite faces of the covered insert adjacent the binding.

5. Apparatus according to claim 1 and further comprising means for applying pressure perpendicular to the opposite faces of the coverwrapped insert and means for forming impressions longitudinally of the cover panels at said opposite faces adjacent the binding.

6. Apparatus according to claim 1 wherein the means for depositing the covers is a hopper and wherein the hopper includes spaced, parallel side wall panels parallel to the path of movement and end plates perpendicular to the path of movement for aligning the stacked covers with their lateral edges parallel to the direction of movement and their leading and trailing edges at right angles to the direction of movement and means for adjusting the distance between the side wall panels to accommodate covers of different size.

7. Apparatus according to claim 1 wherein the means for depositing covers is a hopper structured to receive a stack of covers and means at the bottom of the hopper for ejecting one cover at a time from the bottom of the stack.

8. Apparatus according to claim 7 wherein there is means for adjusting the end plates relative to the bottom of the stack to provide a gap at the bottom of sufficient length to permit but one cover to be ejected at a time.

9. Apparatus according to claim 7 wherein the means at the bottom of the stack for ejecting covers is a reciprocally-mounted feed dog of a vertical height slightly less in thickness than the thickness of the cover to be ejected.

10. Apparatus according to claim 9 wherein there is means for reciprocating the feed dog in timed relation with the movement of the conveyor to insure deposit of covers in the spaces between successive lugs.

11. Apparatus according to claim 7 wherein there is a conveyor provided with longitudinally-spaced lugs for advancing covers ejected from the hopper and feed rolls operable in conjunction with the reciprocally-movable feed dog to deposit the covers onto the conveyor.

12. Apparatus according to claim 1 wherein the heating means is a heat lamp supported above the path of movement of the covers.

13. Apparatus according to claim 12 wherein the heat lamp is adjustable heightwise of the path of movement of the covers.

14. Apparatus according to claim 1 wherein the means for embossing the cover panels are pairs of transversely-mounted rolls rotatable about horizontal axes, the upper roll of each pair being provided with a circumferential rib and the lower roll of each pair with a circumferential groove and wherein the axial distance between the ribs on the upper rolls and the axial distance between the grooves of the lower rolls corresponds substantially to the thickness of the insert.

15. Apparatus according to claim 14 wherein there are pairs of feed rolls preceding and following the embossing rolls.

16. Apparatus according to claim 1 wherein the means for applying adhesive comprise a tray for receiving a quantity of adhesive and a plurality of transfer rolls positioned transversely of the path of movement, one of which rotates in the tray and another of which is arranged to have tangential engagement with a cover moving along said predetermined path.

17. Apparatus according to claim 16 wherein there is means for moving the tray from the position in which the one roll dips into the tray to a remote position to permit replenishing the tray.

18. Apparatus according to claim 1 wherein the means for depositing inserts on the covers comprises a hopper within which is stored a stack of inserts and a reciprocal feed dog at the bottom of the hopper for discharging one insert at a time onto a cover traveling along said predetermined path below the hopper.

19. Apparatus according to claim 18 wherein the hopper has spaced, parallel side walls parallel to the path of movement adjustable transversely to the width of the cover and spaced, parallel end plates at right angles to the path of travel adjustable to the length of the cover and wherein the forward end plate is adjustable in height relative to the bottom of the stack to permit but a single insert to be ejected at a time.

20. Apparatus according to claim 18 wherein there are feed rolls for receiving the ejected inserts and delivering them onto the covers traveling along said path.

21. Apparatus according to claim 1 wherein there is means for positioning the insert on the cover when deposited thereon comprising side guides parallel to the path of movement for engagement with the lateral edges of the cover and insert and lugs on the conveyor operable by engagement with the trailing ends of the cover and insert to center the insert fore and aft with respect to each other.

22. Apparatus according to claim 1 wherein the means for wrapping the cover about the insert comprises an edge guide at one side for engagement with the edge of the cover panel on which rests the insert, means at the other side for lifting the laterally-extending cover panel upwardly and for folding the upwardly-lifted cover panel down onto the upwardly-facing side of the insert and means for holding the insert down on the cover while the laterally-extending portion of the cover is being lifted.

23. Apparatus according to claim 22 comprising pressure-applying rolls supported for tangential engagement with the upper cover panel of the wrapped insert following wrapping.

24. Apparatus according to claim 22 comprising means at said other edge beyond the lifting means for pressing the cover against the edge of the insert.

25. Apparatus according to claim 24 wherein there is means for adjusting the edge guides transversely to accommodate covers of different width.

26. Apparatus according to claim 1 comprising means for applying pressure perpendicular to the opposite cover panels for a predetermined length of time and means for concurrently forming hinges in the cover panels parallel to and adjacent the binding.

27. Apparatus according to claim 26 wherein the means for applying pressure to the wrapped insert comprises spaced, parallel conveyor belts between the lower and upper runs of which the wrapped insert is advanced throughout a predetermined distance by means of the conveyor belts and means for driving the conveyor belts.

28. Apparatus according to claim 27 wherein there is means for adjusting the conveyor belts relative to each other to adjust the magnitude of the pressure applied to the wrapped inserts.

29. Apparatus according to claim 27 wherein the conveyor belts are articulated plates.

30. Apparatus according to claim 27 wherein there are conveyors arranged in advance of the pressure-applying conveyor belts and following the pressure-applying conveyor belts for delivering wrapped inserts into the space between the pressure-applying conveyor belts for application of pressure and for removing the pressurized wrapped inserts from the pressure-applying conveyor belts.

31. A high speed casing-in and building machine comprising in line first means for depositing book covers in a horizontal position with their insides facing inwardly for rectilinear movement in a direction parallel to its opposite edges, second means beyond the first means in the direction of movement for heating an area of the upwardly-facing side of the cover situated at equal distances from the opposite edges which is as long as the back and at least as wide as the thickness of the insert to be covered, third means beyond the second means in the direction of movement operable to form spaced, parallel fold lines defining a binding area corresponding to the thickness of the insert to be covered and the front and back cover panels at either side thereof, fourth means beyond the third means operable to apply adhesive to the entire upwardly-facing side of the cover, fifth means beyond the fourth means for depositing an insert one broad side down upon the adhesive-coated cover at one side of the binding area and coinciding with one of the fold lines and sixth means beyond the fifth means for wrapping the binding area about the back of the insert and folding the cover panel at the other side relative to the cover panel at the one side into adhesive engagement with the upwardly-facing broad side of the insert.

32. Apparatus according to claim 31 comprising means for applying pressure perpendicular to the opposite faces of the cover-wrapped insert for a predetermined length of time and means for concurrently embossing the faces of the cover panels adjacent the binding to form hinges therein.

* * * * *